US005955253A

United States Patent [19]

Kawakami

[11] Patent Number: 5,955,253

[45] Date of Patent: Sep. 21, 1999

[54] SILVER IODIDE FINE GRAIN EMULSION, LIGHTSENSITIVE SILVER HALIDE EMULSION INCLUDING THE SAME AND SILVER HALIDE PHOTOGRAPHIC LIGHTSENSITIVE MATERIAL CONTAINING THE LIGHTSENSITIVE SILVER HALIDE EMULSION

[75] Inventor: Hiroshi Kawakami, Minami-ashigari, Japan

[73] Assignee: Fuji Photo Film Co., Ltd., Minami-Ashigara, Japan

[21] Appl. No.: 09/112,451

[22] Filed: Jul. 9, 1998

[30] Foreign Application Priority Data

Jul. 11, 1997 [JP] Japan ..... 9-201003

[51] Int. Cl.[6] ..... G03C 1/035; G03C 1/025; G03C 1/015

[52] U.S. Cl. ..... 430/568; 430/567; 430/569; 430/30; 430/642

[58] Field of Search ..... 430/568, 30, 567, 430/569, 642

[56] References Cited

U.S. PATENT DOCUMENTS 4,672,026 6/1987 Daubendiek ..... 430/496
5,206,134 4/1993 Yamada et al. ..... 430/569
5,272,027 12/1993 Dillenbeck et al. ..... 430/30
5,605,790 2/1997 Nimura et al. ..... 430/569

FOREIGN PATENT DOCUMENTS 4-319944 11/1992 Japan ..... G03C 1/015

*Primary Examiner*—Mark F. Huff
*Attorney, Agent, or Firm*—Birch, Stewart, Kolasch & Birch, LLP

[57] ABSTRACT

A silver iodide fine grain emulsion comprising a dispersion medium and fine grains of silver iodide has an average grain size of 0.02 to 0.07 $\mu$m, contains 0.6 mol or more of silver iodide per liter thereof in a dissolved state at 40° C., and has an electric conductivity of 4,500 to 15,000 $\mu$S/cm in a dissolved state at 40° C. A lightsensitive silver halide emulsion produced by using the above silver iodide fine grain emulsion is also disclosed. A silver halide photographic lightsensitive material comprising a support and, superimposed thereon, at least one lightsensitive silver halide emulsion layer in which the above lightsensitive silver halide emulsion is contained, is also disclosed.

19 Claims, No Drawings

SILVER IODIDE FINE GRAIN EMULSION, LIGHTSENSITIVE SILVER HALIDE EMULSION INCLUDING THE SAME AND SILVER HALIDE PHOTOGRAPHIC LIGHTSENSITIVE MATERIAL CONTAINING THE LIGHTSENSITIVE SILVER HALIDE EMULSION

BACKGROUND OF THE INVENTION

The present invention relates to a silver iodide fine grain emulsion and a lightsensitive silver halide emulsion containing lightsensitive silver halide grains produced through a step in which silver halide grains are grown by adding the above silver iodide fine grain emulsion.

Generally, silver halide grains are produced by reacting an aqueous solution of a silver salt with an aqueous solution of a halide in a colloidal aqueous solution in a reaction vessel. Single jet method and double jet method are known. In the former method, a protective colloid dispersion medium such as gelatin and an aqueous solution of a halide are placed in a reaction vessel, and, while agitating these, an aqueous solution of a silver salt is added thereto for a given period of time. In the latter method, an aqueous solution of gelatin is placed in a reaction vessel, and an aqueous solution of a halide and an aqueous solution of a silver salt are added thereto for a given period of time. When a comparison is made, it is found that the double jet method is superior to the single jet method in that silver halide grains with narrow grain size distribution can be obtained and that the halogen composition thereof can freely be changed in accordance with the growth of the grains.

It is known that the nucleation and growth of silver halide grains are extensively varied depending on the concentration of silver ions (halide ions) or concentration of silver halide solvent in a reaction solution, the degree of supersaturation, the temperature, etc. Any nonuniformity in the concentration of silver ions or halide ions produced by the silver salt aqueous solution or halide aqueous solution placed in the reaction vessel leads to the occurrence of supersaturation and solubility distributions in the reaction vessel, depending on individual concentrations. Therefore, nonuniformity occurs in the nucleation and growth of silver halide grains.

In particular, it is known that the above nonuniformity is conspicuous in the formation of silver halide grains containing silver iodide. In the emulsion comprising silver halide grains containing silver iodide, it is known that intergrain differences of halogen composition are large due to the variation of silver iodide content among individual silver halide grains and that, even within the same grain, the silver iodide distribution has a bias depending on portions of the grain. Y. T. Tan and R. C. Baetzold presented before the 41st annual meeting of SPSE such a prospect that the iodine within silver iodobromide crystal grains tends to form a cluster on the basis of calculated energy states of silver halide grains. It is presumable that this property of iodine causes the above nonuniformity.

The above nonuniformity is considered to be a factor determining the performance of a silver halide emulsion containing silver iodide. In the art to which the invention pertains, various studies have been made with a view toward resolving the nonuniformity.

The method in which an aqueous solution of a silver salt and an aqueous solution of a halide are rapidly and homogeneously mixed together for resolving the above nonuniformity of silver ion or halide ion concentration is disclosed in, for example, U.S. Pat. No. 3,415,650, GB 1,323,464, U.S. Pat. No. 3,692,283, Jpn. Pat. Appln. KOKOKU Publication No. (hereinafter referred to as JP-B-) 55-10545 and Jpn. Pat. Appln. KOKAI Publication No. (hereinafter referred to as JP-A-) 57-92523. However, the intragrain or intergrain nonuniformity of silver iodide content among silver halide grains, which nonuniformity occurs during the step of forming silver halide grains containing silver iodide, has not been resolved.

On the other hand, JP-A-1-183644 discloses the technique in which silver iodide which contributes to grain formation is fed in the form of a fine grain emulsion in order to resolve the intragrain or intergrain nonuniformity of silver iodide content among silver halide grains containing silver iodide. In the specification of this literature, it is recited that a lightsensitive silver halide emulsion with high sensitivity can be obtained by resolving the intragrain and intergrain nonuniformity of silver iodide content.

Further, JP-A-3-213845 and JP-A-8-29904 disclose the technique in which silver iodide which must be fed for introducing dislocation lines in tabular silver iodobromide grains is fed in the form of a fine grain emulsion. In these patent publications, the reason for using a fine grain emulsion in grain formation would be that it is intended to attain a performance enhancement by minimizing the intergrain nonuniformity.

When the feeding of silver iodide which contributes to formation of grains of the desired silver halide emulsion is conducted in the form of a fine grain emulsion, the silver halide concentration of the fine grain emulsion is a principal factor which influences the productivity of the desired silver halide emulsion. The higher the silver halide concentration of the fine grain emulsion, the greater the amount of silver halide charged in a reaction vessel with limited volume to thereby enable a productivity increase. Moreover, with respect to the handling such as storage, conveyance or weighing of the fine grain emulsion which is needed during a period from after preparation of the fine grain emulsion to production of the desired silver halide emulsion, the higher the silver halide concentration of the fine grain emulsion, fundamentally the greater the attained advantage. That is, when the silver halide concentration is high, the volume/weight of the emulsion becomes small, so that not only can the scale of facilities required for storage, conveyance, weighing, etc. be compacted but also labor workload can be reduced.

However, the heightening of silver halide concentration of the fine grain emulsion has not been sufficiently studied, and the current situation is such that information about the same is poor on the published patents, literature, etc. In particular, information about the increased silver iodide concentration of a silver iodide fine grain emulsion is poor. As a result of the inventors' studies, it has been found that, when the silver iodide concentration of the silver iodide fine grain emulsion is increased, there is such a problem that the storage thereof in a dissolved state or in a refrigerated and set state is accompanied by the occurrence of emulsion grain aggregation with the passage of time. One method of enabling avoiding this problem is provided by the technique disclosed in JP-A-2-172816. This technique comprises preparing a fine grain emulsion in a mixing vessel disposed outside a reaction vessel, immediately thereafter concentrating the fine grain emulsion by passing it through a concentrator in which an ultrafiltration membrane or a semipermeable membrane is used and immediately thereafter placing the concentrate into the reaction vessel. However, this method necessitates a mixer for preparing the fine grain emulsion per reaction vessel and also a concentration unit for concentrating the fine grain emulsion, which includes an ultrafiltration membrane or a semipermeable membrane, a pressure control valve, a pressure sensor, etc. Thus, the problem is encountered such that the emulsion producing apparatus is extremely complicated and, accordingly, the load relating to maintenance of the emulsion producing apparatus is increased.

Therefore, there is a demand for the preparation of a silver iodide fine grain emulsion in which the concentration of silver iodide is high, which is excellent in the stability during the storage in a dissolved state or in a refrigerated and set state and whose aggregation behavior with the passage of time is slight.

BRIEF SUMMARY OF THE INVENTION

A first object of the present invention is to provide a silver iodide fine grain emulsion in which the concentration of silver iodide is high, which is excellent in the stability during the storage in a dissolved state or in a refrigerated and set state and whose emulsion grain aggregation behavior with the passage of time is slight. A second object of the present invention is to provide a lightsensitive silver halide emulsion with high sensitivity by feeding the silver iodide required in the stage of formation of lightsensitive silver halide grains in the form of the above silver iodide fine grain emulsion in which the concentration of silver iodide is high.

DETAILED DESCRIPTION OF THE INVENTION

The objects of the present invention could be attained by the following:

(1) A silver iodide fine grain emulsion comprising a dispersion medium and fine grains of silver iodide, wherein an average grain size of the grains contained in the silver iodide fine grain emulsion is 0.02 to 0.07 μm; at least 0.6 mol of silver iodide is contained per liter of the silver iodide fine grain emulsion in a dissolved state at 40° C.; and the silver iodide fine grain emulsion has an electric conductivity of 4,500 to 15,000 μS/cm in the dissolved state at 40° C.;

(2) The silver iodide fine grain emulsion as recited in item (1) above, wherein the silver iodide fine grain emulsion was produced by using a gelatin whose methionine residue content is 30 μmol/g or less or a gelatin having —$NH_2$ groups, at least 60% of which are chemically modified, in a step from grain formation to completion of desalting;

(3) A lightsensitive silver halide emulsion comprising lightsensitive silver halide grains, wherein the lightsensitive grains were produced through a growing step in which silver halide grains are grown by adding the silver iodide fine grain emulsion of item (1) or (2) above;

(4) The lightsensitive silver halide emulsion as recited in item (3) above, wherein the silver iodide fine grain emulsion was maintained in a dissolved state from immediately after the preparation thereof to the addition for growing the lightsensitive silver halide grains;

(5) The lightsensitive silver halide emulsion as recited in item (3) or (4) above, wherein the silver halide emulsion is occupied by tabular silver halide grains having at least 10 dislocation lines per grain, having mutually parallel principal planes composed of (111) faces, and having an aspect ratio of at least 3, in an amount of 50% or more of the total projected area of all the grains in the silver halide emulsion; and (6) A silver halide photographic lightsensitive material, comprising a support and, superimposed thereon, at least one lightsensitive silver halide emulsion layer, wherein the lightsensitive silver halide emulsion layer contains the lightsensitive silver halide emulsion of any of items (3) to (5) above.

The present invention will be described in detail below.

In the present invention, the term "fine grain emulsion" means the emulsion whose average grain size is 0.02 to 0.07 μm. The term "grain size" is a diameter of a circle having the same projected area of each grain that was measured by a direct electron microscope observation, which will be described in detail later. The term "average grain size" means a number average of the grain sizes of at least 600 grains of arbitrary collected grains from a uniform emulsion.

The silver halide composition of the silver iodide fine grain emulsion of the present invention may consist substantially of silver iodide. The term "consist substantially of silver iodide" used herein means a silver iodobromide, silver iodochloride or silver iodobromochloride having a silver iodide content of at least 85%. The silver halide composition of the fine grain emulsion is preferably 100% silver iodide.

The silver iodide, in its crystal structure, may have a β arrangement, a γ arrangement and, as described in U.S. Pat. No. 4,672,026, an a arrangement or α arrangement quasi-structure. In the present invention, although the crystal structure is not particularly limited, use is made of a mixture of a β arrangement and a γ arrangement, preferably, a β arrangement. The silver iodide grains whose average grain size is 0.02 to 0.07 μm for use in the silver iodide fine grain emulsion of the present invention, per se, can easily be produced by the method described in, for example, U.S. Pat. No. 4,672,026, the disclosure of which is herein incorporated by reference. It is preferred to conduct a double jet addition of an aqueous solution of a silver salt and an aqueous solution of an iodide. It is also preferred to conduct a controlled double jet addition in which grain formation is carried out while holding a pI value constant. Herein, the pI is a logarithm of inverse of $I^-$ ion concentration of the system. The temperature, pI and pH and, also, the presence or absence, type and concentration of a silver halide solvent are not particularly limited.

The average grain size of the silver iodide fine grain emulsion of the present invention is in the range of 0.02 to 0.07 μm, preferably, 0.03 to 0.05 μm. When the average grain size is smaller than the above range, a physical ripening unfavorably occurs during the storage of the emulsion to thereby cause the grain size to easily fluctuate. On the other hand, when the grain size is too large, the solubility is excessively lowered, so that the problem may occur such that, even if the silver iodide fine grain emulsion is added for the purpose of contributing toward the growth of silver iodide regions of lightsensitive silver halide grains, added silver iodide does not deposit on the host grains of lightsensitive silver halide grains with the result that the added silver iodide fine grains remain intact without being able to contribute toward the growth of lightsensitive silver halide grains.

Although the grain configuration cannot be completely specified because of fine grains, the variation coefficient of grain size distribution is preferably 25% or less, more preferably, 20% or less. Herein, the grain size and grain size distribution of the silver iodide fine grain emulsion are determined by placing silver iodide fine grains on a mesh for electron microscope observation and by observing them directly in accordance with the transmission method, not in accordance with the carbon replica method. This is because the grain size is so small that measuring errors would be large in the observation according to the carbon replica method. The grain size is defined as the diameter of a circle having the same projected area as that of the observed grain. The distribution of grain size is also determined from the diameter of the circle having the same projected area. Specifically, the variation coefficient of the grain size distribution is a quotient of a standard deviation divided by an average grain size thereof. The silver iodide fine grains most desired in the present invention have an average grain size of 0.03 to 0.05 $\mu$m and a variation coefficient of grain size distribution of 18% or less.

After the above grain formation, the silver iodide fine grain emulsion is desalted and subjected to regulations of pH, pI, the concentration of dispersion medium such as gelatin and the concentration of contained silver iodide.

With respect to the desalting, any of conventional desalting methods can be employed. For example, use can be made of the method of JP-A-47-4448 in which a refrigerated and set emulsion is cut into small pieces or in noodle-like form and washed with water, the method of JP-A-57-209823 in which an ultrafiltration is conducted with the use of a semipermeable membrane, the method of JP-A-61-219948 in which an ion exchange is utilized and the method of U.S. Pat. No. 2,614,929 in which a flocculation is performed. Of these desalting methods, the flocculation method is preferably employed in the present invention. The disclosures of all the above literatures disclosing the method of desalting are herein incorporated by reference.

In the preparation of the silver iodide fine grain emulsion of the present invention, attention must be paid to the degree of desalting to be conducted. Desalting is preferably conducted to such a degree that the electric conductivity of the emulsion immediately after the completion of the desalting ranges from 4,500 to 15,000 $\mu$S/cm in a dissolved state at 40° C. When the electric conductivity of the emulsion immediately after the completion of the desalting is lower or higher than the above range, an aggregation of emulsion grains is likely to occur. In the case where the electric conductivity of the emulsion immediately after the completion of the desalting is within the range of 4,500 to 15,000 $\mu$s/cm, the range will be maintained after the desalting, so that the aggregation is not likely to occur.

It is preferred that the pH value of the silver iodide fine grain emulsion of the present invention be adjusted so as to range from 5 to 7. The pI value is preferably set near that which minimizes the solubility of silver iodide. It is requisite that the electric conductivity of the emulsion be adjusted so as to fall within the range of from 4,500 to 15,000 $\mu$S/cm in a dissolved state at 40° C. The electric conductivity of the emulsion is preferably adjusted so as to fall within the range of from 6,000 to 12,000 $\mu$S/cm.

The adjustment of the electric conductivity can be easily conducted by various methods such as changing the degree of desalting and adding an electrolyte in the step of dispersion after desalting. The degree of desalting can be easily regulated by, for example, controlling the frequency of water washing, the addition amount of washing water and the amount of supernatant water withdrawn after coagulation precipitation to thereby change a water washing ratio, in the instance of the flocculation method. The term "water washing ratio" used herein means a ratio of (volume just before coagulation precipitation)/(volume after coagulation precipitation and withdrawal of supernatant water).

When the water washing is conducted a plurality of times, the total water washing ratio means the product of all individual water washing ratios multiplied together. For example, when the water washing is conducted thrice, the total water washing ratio means the product of (water washing ratio at the first water washing)×(water washing ratio at the second water washing)×(water washing ratio at the third water washing).

Although the protective colloid dispersion medium of the silver iodide fine grain emulsion of the present invention may be common gelatin or another polymeric compound having protective colloid function, for example, a polymer having a thioether group as described in U.S. Pat. No. 3,615,624, the disclosure of which is herein incorporated by reference, and other literature or a vinyl polymer having an imidazole group, a polyvinylpyrrolidone polymer or a cellulose or starch derivative as described in U.S. Pat. No. 3,520,857, the disclosure of which is herein incorporated by reference, and other literature, it is preferred that the protective colloid dispersion medium used through the steps from the initiation of emulsion grain formation to completion of desalting be a gelatin whose methionine residue content is 30 $\mu$mol/g or less or a gelatin having —$NH_2$ groups, at least 60% of which are chemically modified. This is because the aggregation behavior of emulsion grains is reduced during the storage in a dissolved state or a refrigerated and set state in conformity with the object of the present invention. The protective colloid dispersion medium to be used in the invention can meet both of the limitations, i.e., the methionine residue content is 30 $\mu$mol/g or less and at least 60% of the —$NH_2$ groups are chemically modified, at the same time.

In the above protective colloid dispersion medium used through the steps from the initiation of emulsion grain formation to completion of desalting, the content of the gelatin whose methionine residue content is 30 $\mu$mol/g or less or gelatin having —$NH_2$ groups, at least 60% of which are chemically modified, is preferably at least 60% by weight, more preferably, at least 90% by weight, based on the total dispersion medium.

The methionine residue content of gelatin can be determined by first completely decomposing gelatin into amino acids according to the alkali hydrolysis process and then analyzing with the use of an amino acid analyzer to thereby measure the amount of methionine residue relative to the amount of glycine residue. For details, reference can be made to the description of JP-A-7-311428, the disclosure of which is herein incorporated by reference. The methionine residue content of gelatin can be regulated by adding an oxidizer to an aqueous solution of gelatin to thereby oxidize the —S— group of a methionine residue into at least one of a sulfoxide, a sulfonate and a sulfone. The oxidation into a sulfoxide is preferred. That is, the product of oxidation of methionine residue is not regarded as methionine residue in the present invention. The level of the oxidation can primarily be regulated by selecting the type of added oxidizer and the addition amount thereof. The temperature of the aqueous solution preferably ranges from 20 to 70° C., more preferably, from 35 to 50° C. The pH value thereof preferably ranges from 3 to 9, more preferably, from 4 to 7. Generally, an oxidizer is added to an aqueous solution of gelatin having a temperature and pH value held constant and homogeneously mixed together. Subsequently, a container lid is closed, and the mixture is allowed to stand still at a constant temperature for a period of, preferably, 15 min to 3 days and, more preferably, 2 to 24 hr. With respect to the oxidizer, reference can be made to JP-A-7-311428, the disclosure of which is herein incorporated by reference. Generally, $H_2O_2$ can preferably be used.

The absorption coefficient (wavelength region: 200 to 500 nm) of gelatin is lowered by the above oxidation. Therefore, if, with respect to a particular gelatin, samples with varied oxidation levels are prepared and a relationship between absorption coefficient and methionine residue content is determined in advance, the methionine residue content of the gelatin can be easily determined by measuring the absorption coefficient.

The amino acid residue composition of standard gelatin is described in "The Theory of The Photographic Process", Chapter 2, Macmillan (1977). The methionine residue content thereof can be regarded as being close to 80 $\mu$mol/g. The methionine residue content of gelatin used through the steps from emulsion grain formation to completion of desalting for the silver iodide fine grain emulsion of the present invention preferably ranges from 30 to 0 $\mu$mol/g, more preferably, from 20 to 0 $\mu$mol/g.

The modified gelatin will now be described in detail.

As the —$NH_2$ group of gelatin, for example, the amino group at a terminal portion of gelatin molecule, the amino group of lysine, hydroxylysine, histidine or arginine residue, or the amino group of ornithine that originates in arginine residue being converted thereto, can be mentioned. Further, the amino group of an adenine or a guanine residues, both of which are impurity residues of gelatin, can be mentioned.

The chemical modification of the —$NH_2$ group means adding a reactive agent to gelatin and reacting the reactive agent with the amino group to thereby form a covalent bond or effect a deamination. That is, the chemical modification means converting a primary amino group (—$NH_2$) to a secondary amino group (—NH—), a tertiary amino group or a deaminated group.

Specifically, for example, the chemical modification can be performed by adding to gelatin a reactive agent, followed by the above reaction. Examples of the reactive agent are an acid anhydride (e.g., maleic acid anhydride, o-phthalic acid anhydride, succinic acid anhydride, isatoic acid anhydride or benzoic acid anhydride), an acid halide (e.g., R—COX, R—$SO_2$X or R—O—COX (wherein R represents an alkyl group and X represents a halogen atom (F, Cl, Br or I)), or phenyl-COCl), a compound having an aldehyde group (e.g., R—CHO), a compound having an epoxy group, a deaminating agent (e.g., $HNO_2$ or deaminase), an active ester compound (e.g., sulfonic acid ester, p-nitrophenyl acetate, isopropenyl acetate, methyl o-chlorobenzoate, or p-nitrophenyl benzoate), an isocyanate compound (e.g., aryl isocyanate), an active halogenated compound (e.g., aryl halide (benzyl bromide, biphenylhalomethane, benzoylhalomethane, phenylbenzoylhalomethane or 1-fluoro-2,4-dinitrobenzene), β-ketohalide, α-halofatty acid, β-halonitrile or chlorinated derivative of s-triazine, pyrimidine, pyridazine, pyrazine, pyrrolidazone, quinoxaline, quinazoline, phthalazine, benzoxazole, benzothiazole or benzimidazole), a carbamoylating agent (e.g., cyanic acid salt or nitrourea), a compound having an acrylic active double bond group (e.g., maleimide, acrylamide, acrylonitrile, methyl methacrylate, vinylsulfone, vinylsulfonic acid ester, sulfonamide, styrene, vinylpyridine, acrylamine, butadiene, isoprene or chloroprene), a sultone (e.g., butanesultone or propanesultone), a guanidinizing agent (e.g., o-methylisourea), a carboxylazide.

In this instance, the agent which mainly reacts with the —$NH_2$ group of gelatin is preferred to the agent which also reacts with the —OH group or —COOH group of gelatin to thereby form a covalent bond. The term "mainly" used herein means at least 60%, preferably, 80 to 100% and, more preferably, 95 to 100% of the total sum number of —$NH_2$ groups, —OH groups and —COOH groups of gelatin. Furthermore, the reaction product is preferably in a form substantially not containing an ether group or ketone group whose oxygen is substituted with a chalcogen atom, for example, —S— or a thione group. The term "substantially not containing" used herein means, preferably, 10% or less, more preferably, 0 to 3% of the number of chemically modified groups. Thus, of the above agents, an acid anhydride, a sultone, a compound having an active double bond group, a carbamoylating agent, an active halogenated compound, an isocyanate compound, an active ester compound, a compound having an aldehyde group and a deaminating agent are preferred.

The chemical modification is preferably conducted in a mode substantially not forming any crosslink between gelatin molecules. The term "substantially not forming" means, preferably, 10% or less, more preferably, 0 to 3%, of the chemically modified groups.

For details of the above chemical modification agents, gelatin chemical modification method and other related matter, reference can be made to the following literature, i.e., JP-A-4-226449, JP-A-50-3329, U.S. Pat. No. 2,525,753, U.S. Pat. No. 2,614,928, U.S. Pat. No. 2,614,929, U.S. Pat. No. 2,763,639, U.S. Pat. No. 2,594,293, U.S. Pat. No. 3,132,945, "Glue and Gelatin" edited by Yoshihiro Abiko, Chapter II, Japan Glue & Gelatin Industrial Association (1987) and "The Science and Technology of Gelatin" edited by Ward, Chapter 7, Academic Press (1977), the disclosures of which are herein incorporated by reference.

The chemical modification percentage (%) of —$NH_2$ groups of modified gelatin can be determined by the following method. That is, unmodified gelatin and modified gelatin are provided, and the numbers of —$NH_2$ groups thereof are determined and represented by $e_1$ and $e_2$, respectively. The chemical modification percentage (%) can be calculated by the formula: $100\times(e_1-e_2)/e_1$. The $e_1$ and $e_2$ can be determined by the use of infrared absorption intensity ascribed to —$NH_2$ group, NMR signal intensity of proton thereof, color reaction or fluorescent reaction. For details of these, reference can be made to Bunseki Kagaku Binran (Analytical Chemistry Manual), Organic Section 2, Maruzen Co., Ltd. (1991), the disclosure of which is herein incorporated by reference. The determination can also be conducted by, for example, the change of gelatin titration curve or formol titration method. For details thereof, reference can be made to "The Science and Technology of Gelatin", Chapter 15, Academic Press (1977), the disclosure of which is herein incorporated by reference.

Furthermore, the determination can be conducted by adding a mixture of glutaraldehyde and Britton-Robinson high pH buffer to a gelatin solution of a specified concentration, coloring the resultant mixture and measuring a spectral absorption intensity thereof near 450 nm to thereby effect colorimetry (reference can be made to the description of Photographic Gelatin II, p. 297–315, Academic Press (1976), the disclosure of which is herein incorporated by reference).

The ratio of number of chemically modified —$NH_2$ groups to number of —$NH_2$ groups of gelatin used through the steps from emulsion grain formation to completion of desalting for the silver iodide fine grain emulsion of the present invention is preferably at least 60%, more preferably, in the range of 90 to 100%.

With respect to the molecular weight of gelatin used in the silver iodide fine grain emulsion of the present invention, preferred use is made of gelatin whose average molecular weight is approximately 100 thousand or a low molecular weight gelatin whose average molecular weight is 20 thousand or less. The employment of a mixture of gelatins with different molecular weights as mentioned above may be advantageous.

The amount of gelatin per liter of the emulsion is preferably in the range of 10 to 80 g, more preferably, 20 to 60 g. When the amount of gelatin is smaller than the above range, the problem is encountered such that syneresis water is likely to occur during the storage of the emulsion in a refrigerated and set state. On the other hand, when the amount of gelatin is larger than the range, the problem is encountered such that the viscosity of the emulsion is extremely increased to thereby cause handling of the emulsion to be difficult.

Generally, the higher the silver iodide concentration of the emulsion, the greater the realized advantage. This is, for example, because the burden of production equipment is lessened. Although the silver iodide concentration of the emulsion can be appropriately set in accordance with employed production equipment, etc., the silver iodide concentration can generally be so set as to fall within the range of 0.6 to 1.0 mol/L(liter), preferably in the range of 0.65 to 0.85 mol/L.

The silver iodide fine grain emulsion of the present invention is used for feeding required silver iodide in the growth of desired lightsensitive silver halide emulsion grains. That is, in a reaction vessel, the silver iodide fine grain emulsion of the present invention is added during the growing of silver halide phase containing silver iodide. Specifically, after the nucleation of desired lightsensitive silver halide emulsion grains is carried out by the common method comprising mixing together an aqueous solution of a silver salt and an aqueous solution of a halide, then ripening and growth are conducted, if necessary. Then, a silver halide phase containing silver iodide is grown on formed host grains. The silver iodide fine grains placed in the reaction vessel are dissolved and settle on the above host grains to thereby contribute to growth of nuclear grains.

Although the silver iodide fine grain emulsion of the present invention may be added to a host grain emulsion at any of the stages from the start of growth of the host grain emulsion to the completion of the process for producing the desired lightsensitive silver halide emulsion as long as the addition is conducted after the completion of nucleation of the host grain emulsion, it is preferred that the addition of the silver iodide fine grain emulsion of the present invention be performed during the stage from the start of growth of the host grain emulsion to just before the initiation of chemical sensitization of host grains.

Although the addition of the silver iodide fine grain emulsion of the present invention to the host grain emulsion can be performed by a method selected from among the method in which the silver iodide fine grain emulsion is added in a dissolved state and the method in which the addition is conducted in the form of a solid in a set state, the former method of adding the silver iodide fine grain emulsion in a dissolved state, preferably at a temperature of 35° C. to 50° C., is preferred. This is because, after the addition of silver iodide fine grains, the added silver iodide fine grains can immediately homogeneously be mixed with the host grain emulsion so that the subsequent step can be proceeded to. Further, the silver iodide fine grain emulsion of the present invention can be held in a dissolved state throughout the stages from the preparation thereof to the addition to the host grain emulsion. This is advantageous when the storage, conveyance and weighing of the silver iodide fine grain emulsion are automated.

Although the halogen composition of the host grains to which the silver iodide fine grain emulsion of the present invention is fed is not particularly limited, it is preferred that the halogen composition consist of silver bromide or silver iodobromide which contains silver iodide in an amount of 20 mol % or less on the average.

Although the crystal habit of the host grains to which the silver iodide fine grain emulsion of the present invention is fed is also not particularly limited, it is preferred that each of the host grains is tabular silver halide grain having mutually parallel principal planes composed of (111) faces. Further, it is preferred that the host grain emulsion be a silver bromide or silver iodobromide emulsion, at least 50% of the total projected area of which is occupied by tabular grains having an aspect ratio of at least 3. When the host grains are tabular silver iodobromide, the silver iodide content is preferably 20 mol % or less, because the variation coefficient of grain size distribution of the host grain emulsion is preferably 25% or less. Lowering the silver iodide content facilitates the decreasing of the variation coefficient of grain size distribution of the tabular host grain emulsion. In particular, the variation coefficient of grain size distribution of the tabular host grain emulsion is preferably 20% or less and the silver iodide content is preferably 10 mol % or less.

The projected area and aspect ratio of tabular grains can be measured from an electron micrograph obtained by the carbon replica method in which the tabular grains are shadowed together with reference latex spheres. When viewed in the direction perpendicular to the principal planes, the tabular grains generally have a hexagonal, a triangular or a circular shape. The aspect ratio is the quotient of the equivalent diameter, i.e., the diameter of a circle having the same area as the projected area thereof divided by the thickness. With respect to the shape of the tabular grains, the higher the proportion of hexagon, the greater the realized advantage. Further, it is preferred that the length ratio of neighboring sides of the hexagon be 1:2 or less. Moreover, at least 50% of the total projected area of the host tabular grain emulsion is occupied by grains with an aspect ratio of, preferably, at least 5, more preferably, at least 8. However, when the aspect ratio is too high, the above variation coefficient of grain size distribution tends to be too large. Therefore, it is generally preferred that the aspect ratio be 20 or less.

The tabular grains preferred as the host grains to which the silver iodide fine grain emulsion of the present invention is fed have (111) principal planes opposite to each other and side faces which connect the principal planes. At least one twin plane is interposed between the principal planes. Generally, two twin planes are observed in the host tabular grains. The spacing of the two twin planes can be less than 0.012 $\mu$m as described in U.S. Pat. No. 5,219,720, which is herein incorporated by reference. Further, the quotient of distance between (111) principal planes divided by the twin plane spacing can be at least 15 as described in JP-A-5-249585, which is herein incorporated by reference.

Tabular grains having side faces which connect the (111) principal planes opposite to each other, 75% or less of all the side faces composed of (111) faces, can be mentioned as an example of the tabular grains especially preferred as the host grains to which the silver iodide fine grain emulsion of the present invention is fed. The above description "75% or less of all the side faces composed of (111) faces" means that crystallographic faces other than the (111) faces exist at a proportion higher than 25% of all the side faces. Such other crystallographic faces can generally be comprehended as being (100) faces. However, other faces, namely, (110) faces and faces with higher index can be included therein. It is still preferred that 70% or less of all the side faces be composed of (111) faces.

Whether or not 70% or less of all the side faces are composed of (111) faces can easily be judged from an electron micrograph obtained by the carbon replica method in which the host tabular grains are shadowed. When 75% or more of all the side faces are composed of (111) faces, in hexagonal tabular grains, generally six side faces directly connect with (111) principal plane with an acute angle and an obtuse angle therefrom alternately. On the other hand, when 70% or less of all the side faces are composed of (111) faces, in hexagonal tabular grains, six side faces directly connect with (111) principal plane with an obtuse angle therefrom without exception. Whether the angle of each side face from the other principal plane (principal plane opposite to one of the principal planes; principal back plane) is acute or obtuse can be judged by applying the shadowing at an angle of up to 50 degree. The shadowing is preferably applied at an angle of 30 to 10 degree. This facilitates the judging as to whether the angle is acute or obtuse.

An effective method for determining the ratio of (111) faces to (100) faces is one in which the adsorption of a spectral sensitizing dye is utilized. The ratio of (111) faces to (100) faces can quantitatively be determined by the use of the method described in Journal of the Chemical Society of Japan, 1984, vol. 6, pp. 942–947, the disclosure of which is herein incorporated by reference. The ratio of (111) faces to all the side faces can be calculated from the above ratio of (111) faces to (100) faces, equivalent circular diameter of tabular grains and thickness. In this instance, it is assumed that the tabular grains are cylinders with the use of the above equivalent circular diameter and thickness. This assumption enables determining the ratio of side faces to the total surface area. The value obtained by dividing the above (100) face ratio determined with the use of the adsorption of a spectral sensitizing dye by the above side face ratio and multiplying the resultant quotient by 100 is the ratio of (100) faces to all the side faces. The ratio of (111) faces to all the side faces is determined by subtracting the above value from 100.

With respect to the method of changing the plane index of side faces of the host tabular grains, reference can be made to, for example, European Patent (hereinafter referred to as "EP") 515,894A1, the disclosure of which is herein incorporated by reference. In the above method, use can be made of polyalkylene oxide compounds described in, for example, U.S. Pat. No. 5,252,453, the disclosure of which is herein incorporated by reference. Effective methods can be provided by the use of plane index modifiers described in for example, U.S. Pat. No. 4,680,254, U.S. Pat. No. 4,680,255, U.S. Pat. No. 4,680,256 and U.S. Pat. No. 4,684,607, the disclosures of which are herein incorporated by reference. Common photographic spectral sensitizing dyes can also be used as the same plane index modifiers as mentioned above.

It is desirable to select pBr enabling an increase of the ratio of (100) faces to the side faces during the formation of the host grains. The pBr enabling an increase of the ratio of (100) faces to the side faces is widely variable depending on, for example, the temperature and pH of the system, the type and concentration of a dispersion medium such as gelatin and the use, type and concentration of a silver halide solvent. Generally, the pBr preferably ranges from 2.0 to 5.0, more preferably, from 2.4 to 4.5. However, the value of pBr is readily variable, for example, by the presence of a silver halide solvent or the like, as mentioned above. It is preferred that no silver halide solvent be employed in the formation of the host tabular grains to which the silver iodide fine grain emulsion of the present invention is fed.

When the host grains consist of silver iodobromide, it may be preferred that the tabular grain emulsion have an intragrain structure with respect to the distribution of silver iodide. With respect to the distribution of silver iodide, the tabular grains can have a double structure, a triple structure, a quadruple structure or a structure of higher degree. In any of the structures, it is especially preferred that the outermost layer thereof consist of silver bromide substantially not containing silver iodide. The term "silver bromide substantially not containing silver iodide" means that the silver iodide content of the outermost layer is up to 3 mol %, most preferably, up to 1 mol %, based on the silver halide of the outermost layer. For example, grains with a triple structure consisting of silver bromide|silver iodobromide|silver bromide, the order is from inside toward outside of the triple structure, can be mentioned as preferred structure of the host tabular grains. Other structures of higher degree are also favorable as long as the outermost layer thereof consists of silver bromide substantially not containing silver iodide. The interstructural boundary of silver iodide content may be either clear or continuously and gently changing. In the measurement of silver iodide content according to the powder X-ray diffractometry, generally, X-ray diffraction profiles are obtained in which no two clear peaks of different silver iodide contents are formed and, instead, a gentle slope is formed toward a high silver iodide content.

In the present invention, it is preferred that the silver iodide content of a layer disposed inside and directly adjacent to the outermost layer is higher than that of the outermost layer. The silver iodide content of at least one layer disposed inside the outermost layer is preferably at least 3 mol %, more preferably, at least 5 mol %, based on the silver halide of the at least one layer positioned inside the outermost layer.

As long as the above requirements are satisfied, the silver iodobromide or silver bromide host tabular grains can be produced by any of various processes. The production of the host tabular grains is generally performed through the three fundamental steps, i.e., nucleation, ripening and growth steps.

The use in nucleation step of gelatin having a low methionine residue content as described in U.S. Pat. No. 4,713,320 and U.S. Pat. No. 4,942,120, the nucleation at high pBr as described in U.S. Pat. No. 4,914,014 and the nucleation in a short period of time as described in JP-A-2-222940 are extremely effective in the step of nucleation of host grains to which the silver iodide fine grain emulsion of the present invention is fed, the disclosures of which are herein incorporated by reference.

The ripening in the presence of a low-concentration base as described in U.S. Pat. No. 5,254,453 and the ripening at high pH as described in U.S. Pat. No. 5,013,641 may be effective in the step of ripening of host grains to which the silver iodide fine grain emulsion of the present invention is fed, the disclosures of which are herein incorporated by reference.

Gelatin having —$NH_2$ groups, at least 60% of which are chemically modified, i.e., same gelatin as above used through the above steps from emulsion grain formation to completion of desalting, is preferably used as the dispersion medium of the host tabular grains. The content of gelatin having —$NH_2$ groups, at least 60% of which are chemically modified, in the dispersion medium of the host tabular grains is preferably at least 30% by weight, more preferably, at least 60% by weight.

Although the crystal habit of silver halide grains produced through the step of growing silver halide grains by adding the silver iodide fine grain emulsion of the present invention is not particularly limited, tabular silver halide grains having parallel principal planes composed of (111) faces are preferred. Further, a silver iodobromide emulsion, at least 50% of the total projected area of which is occupied by tabular grains having an aspect ratio of at least 3, is preferred. When the grains are tabular silver iodobromide, the silver iodide content is preferably 20 mol % or less, because the variation coefficient of grain size distribution of the grains is preferably 25% or less. Lowering the silver iodide content facilitates the decreasing of the variation coefficient of grain size distribution. It is especially preferred that the variation coefficient of grain size distribution be 20% or less. With respect to the shape of the tabular grains, the higher the proportion of hexagon, the greater the realized advantage. Further, it is preferred that the length ratio of neighboring sides of the hexagon be 1:2 or less. Moreover, at least 50%, preferably at least 70% of the total projected area of the host tabular grain emulsion is occupied by grains with an aspect ratio of, preferably, at least 5. More preferably, at least 50%, much more preferably at least 70% of the total projected area of the host tabular grain emulsion is occupied by grains with an aspect ratio of at least 8. However, when the aspect ratio is too high, the above variation coefficient of grain size distribution tends to be too large. Therefore, it is generally preferred that the aspect ratio be 20 or less.

The silver halide grains produced through the step of growing silver halide grains by adding the silver iodide fine grain emulsion of the present invention preferably have an intragrain structure with respect to the distribution of silver iodide. With respect to the distribution of silver iodide, the silver halide grains can have a double structure, a triple structure, a quadruple structure or a structure of higher degree. Although, for example, a quintuple structure consisting of silver bromide|silver iodobromide|silver bromide|silver iodobromide|silver bromide can be mentioned as preferred structure, other structures of higher degree are also favorable. The order of the enumerated silver halides is from the inside to the outside of the quintuple structure. The interstructural boundary of silver iodide content may be either clear or continuously and gently changing. In the measurement of silver iodide content according to the powder X-ray diffractometry, generally, X-ray diffraction profiles are obtained in which no two clear peaks of different silver iodide contents are formed and, instead, a gentle slope is formed toward a high silver iodide content.

Dislocation lines are preferably introduced in the silver halide grains produced through the step of growing silver halide grains by adding the silver iodide fine grain emulsion of the present invention, by rapidly adding the silver iodide fine grain emulsion to the above silver iodobromide or silver bromide host tabular grains. This introduction is performed by substantially two steps, i.e., one in which the silver iodide fine grain emulsion is rapidly added to the host tabular grains and the other in which, thereafter, the silver bromide or silver iodobromide is grown to thereby effect introduction of dislocation lines. These two steps may be performed completely separately or may be simultaneously performed in duplication. Preferably, the two steps are separately performed. The first step in which the silver iodide fine grain emulsion is rapidly added to the host tabular grains will be described below.

The term "rapidly adding the silver iodide fine grain emulsion" used herein means that the silver iodide fine grain emulsion is added, preferably, within 10 min, more preferably, within 5 min. Although this addition condition is variable depending on, for example, the temperature, pBr and pH of the addition system, the type and concentration of a protective colloid agent such as gelatin and the use, type and concentration of a silver halide solvent, the shorter the addition time, the greater the realized advantage, as mentioned above. When the addition is conducted, it is preferred that substantially none of aqueous solution of a silver salt such as silver nitrate be added. At the time of addition, the temperature of the system preferably ranges from 40 to 90° C., more preferably, from 50 to 80° C. The most suitable value of pBr at the time of addition depends on the temperature of the system. For example, when the temperature of the system is 75° C., the pBr preferably ranges from 0.8 to 2.0.

The amount of silver iodide fine grain emulsion added when dislocation lines are introduced by rapidly adding the silver iodide fine grain emulsion to the silver iodobromide or silver bromide host tabular grains preferably ranges from 1 to 10 mol %, more preferably, from 3 to 7 mol %, in terms of silver quantity, based on the host tabular grain emulsion. The below described dislocation lines are preferably introduced by selecting the addition amount, thereby contributing to an enhancement of emulsion performance, for example, an enhancement of photographic sensitivity. While the silver iodide fine grain emulsion is generally dissolved prior to addition thereof, the agitation efficiency of the system has to be satisfactorily enhanced at the time of addition. The agitation rotating speed is preferably set higher than common one. The addition of an antifoaming agent is effective in preventing the foaming during agitation. For example, use is made of antifoaming agents described in Examples or other parts of U.S. Pat. No. 5,275,929, the disclosure of which is herein incorporated by reference.

In order to introduce dislocation lines through rapidly adding the silver iodide fine grain emulsion to the silver iodobromide or silver bromide host tabular grains, the rapid addition of the silver iodide fine grain emulsion to the host tabular grain emulsion is preferably followed by growth of silver bromide or silver iodobromide so that dislocation lines are introduced. Although the growth of silver bromide or silver iodobromide may be initiated prior to or simultaneously with the addition of the silver iodide fine grain emulsion, it is preferred that the addition of the silver iodide fine grain emulsion be followed by the initiation of the growth of silver bromide or silver iodobromide. The interval from the addition of the silver iodide fine grain emulsion to the initiation of the growth of silver bromide or silver iodobromide preferably ranges from 10 min to 1 sec, more preferably, from 5 min to 3 sec and, most preferably, from 3 min to 10 sec. Fundamentally, the smaller this time interval, the better. However, when the time interval is too small, the repeated reproducibility of photographic performance may be deteriorated depending on such conditions as, for example, temperature and pBr, immediately after the addition of the silver iodide fine grains. Therefore, the above time interval is preferably set at appropriate value, depending on conditions immediately after the addition of silver iodide fine grains. It is preferred that the addition of the silver iodide fine grains be entirely completed before the initiation of the growth of silver bromide or silver iodobromide.

In the case where dislocation lines are introduced through rapidly adding the silver iodide fine grain emulsion to the host tabular grains of silver iodobromide or silver bromide, silver bromide is preferably grown after the addition of the silver iodide fine grain emulsion. If silver iodobromide is grown, the silver iodide content is preferably within 5 mol %, more preferably, within 3 mol % based on the silver halide of the layer.

The amount of silver in the layer grown after the addition of the silver iodide fine grain emulsion preferably ranges from 20 to 70, more preferably, from 25 to 65, assuming that the amount of silver in the host tabular grain emulsion is 100. Although the temperature, pH and pBr to be exhibited at the formation of the layer are not particularly limited, the temperature and pH generally range from 40 to 90° C. and from 2 to 9, respectively, and, preferably, from 50 to 80° C. and from 3 to 7, respectively. With respect to pBr, it is preferred that the pBr exhibited at the completion of formation of the layer be higher than that exhibited at the initial stage of formation of the layer in the present invention. Preferably, the pBr exhibited at the initial stage of formation of the layer is up to 2.9 and the pBr exhibited at the completion of formation of the layer is at least 1.0. More preferably, the pBr exhibited at the initial stage of formation of the layer is up to 2.5 and the pBr exhibited at the completion of formation of the layer is at least 1.4. Most preferably, the pBr exhibited at the initial stage of formation of the layer is up to 2.1 and the pBr exhibited at the completion of formation of the layer is at least 1.6. Dislocation lines are preferably introduced by the above methods.

The dislocation lines of tabular grains introduced by the above methods can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 35, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the principal planes.

The number of dislocation lines is, preferably, at least 10 per grain on the average and, more preferably, at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof.

Dislocation lines can be introduced in, for example, the vicinity of the periphery of tabular grains. In this instance, the dislocation line is nearly perpendicular to the periphery, and each dislocation line extends from a position corresponding to x% of the distance from the center of tabular grains to the side (periphery), to the periphery. The value of x preferably ranges from 10 to less than 100, more preferably, from 30 to less than 99 and, most preferably, from 50 to less than 98. The area from a position corresponding to x% of the distance from the center of tabular grains to the periphery, to the periphery is herein also called a fringe part. In this instance, the figure created by binding the positions from which the dislocation lines start is nearly similar to the configuration of the grain. The created figure may be one which is not a complete similar figure but deviated. The dislocation lines of this type are not observed at the center region of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel principal planes of each tabular grain. In the case where dislocation lines are formed over the entire regions of the principal planes, the dislocation lines may crystallographically be oriented approximately in the (211) direction when viewed in the direction perpendicular to the principal planes, and the formation of the dislocation lines may be effected either in the (110) direction or randomly. Further, the length of each dislocation line may be random, and the dislocation lines may be observed as short lines on the principal planes or as long lines extending to the side (periphery). The dislocation lines may be straight or often meander. In many instances, the dislocation lines cross each other.

The position of dislocation lines may be localized on the periphery, principal planes or local points as mentioned above, or the formation of dislocation lines may be effected on a combination thereof. That is, dislocation lines may be concurrently present on both the periphery and the principal planes. It is preferred that the dislocation lines be present on the fringe part only.

Examples of silver halide solvents which can be used in the process for producing silver halide grains through the step of growing silver halide grains by the addition of the silver iodide fine grain emulsion of the present invention include (a) organic thioethers as described in, for example, U.S. Pat. No. 3,271,157, U.S. Pat. No. 3,531,289, U.S. Pat. No. 3,574,628, JP-A-54-1019 and JP-A-54-158917, (b) thiourea derivatives as described in, for example, JP-A-53-82408, JP-A-55-77737 and JP-A-55-2982, (c) silver halide solvents having a thiocarbonyl group interposed between an oxygen or a sulfur atom and a nitrogen atom as described in JP-A-53-144319 and (d) imidazoles as described in JP-A-54-100717, (e) sulfites, (f) ammonia and (g) thiocyanates.

Preferred solvents are thiocyanates, ammonia and tetramethylthiourea. The amount of added solvent depends on the type of the solvent. For example, when a thiocyanate is used, its preferable amount is in the range of $1\times10^{-4}$ to $1\times10^{-2}$ mol per mol of silver halide.

The photographic sensitivity of the silver halide grain emulsion produced through the step of growing silver halide grains by the addition of the silver iodide fine grain emulsion of the present invention can be enhanced by subjecting the silver halide grain emulsion to a reduction sensitization. Although the time at which the reduction sensitization is carried out may fundamentally be in any of the steps of grain formation, desalting, dispersion and chemical sensitization of the process for producing the silver halide emulsion, it is preferred in the present invention that the reduction sensitization be performed in the grain formation step, especially, in the step of forming the host tabular grains. The reduction sensitization may be performed at any of the nucleation stage which constitutes an initial stage of the host tabular grain formation, the physical ripening stage and the growth stage. The reduction sensitization performed at the growth stage comprehends the method in which the reduction sensitization is carried out in a growing state and the method in which the growth is temporarily halted in the course of growth, the reduction sensitization is then conducted and a further growth is continued.

The reduction sensitization method can be selected from among the method in which at least one known reduction sensitizer is added to the silver halide emulsion, the method commonly known as silver ripening in which growth or ripening is carried out in an environment of pAg as low as 1 to 7 and the method commonly known as high-pH ripening in which growth or ripening is carried out in an environment of pH as high as 8 to 11. At least two of these methods can be used in combination.

The above method in which a reduction sensitizer is added is preferred from the viewpoint that the level of reduction sensitization can be finely regulated.

Examples of known reduction sensitizers include stannous salts, amines and polyamic acids, hydrazine derivatives, formamidinesulfinic acid, silane compounds and borane compounds. In the present invention, appropriate one may be selected from among these known compounds and used or at least two may be selected and used in combination. Preferred reduction sensitizers are stannous chloride, thiourea dioxide and dimethylaminoborane. Although the addition amount of reduction sensitizer must be selected because it depends on the emulsion manufacturing conditions, it is generally preferred that the addition amount ranges from $10^{-7}$ to $10^{-3}$ mol per mol of silver halide.

Ascorbic acid and its derivatives can also be used as the reduction sensitizer.

Examples of ascorbic acid and its derivatives (hereinafter referred to as "ascorbic acid compounds") include:

(V-1) L-ascorbic acid, (V-2) sodium L-ascorbate, (V-3) potassium L-ascorbate, (V-4) DL-ascorbic acid, (V-5) sodium D-ascorbate, (V-6) L-ascorbic acid-6-acetate, (V-7) L-ascorbic acid-6-palmitate, (V-8) L-ascorbic acid-6-benzoate, (V-9) L-ascorbic acid-5,6-diacetate, and (V-10) L-ascorbic acid-5,6-O-isopropylidene.

The ascorbic acid compound is preferably added in an amount greater than that preferred for common reduction sensitizers. For example, JP-B-57-33572 describes that the amount of reducing agent generally does not exceed $0.75\times10^{-2}$ milliequivalent per g of silver ion ($8\times10^{-4}$ mol/mol of AgX according to conversion by the inventors) and that, in many instances, the effective amount thereof ranges from 0.1 to 10 mg per kg of silver nitrate (as ascorbic acid, $10^{-7}$ to $10^{-5}$ mol/mol of AgX according to conversion by the inventors). U.S. Pat. No. 2,487,850 describes that the addition amount in which a tin compound as a reduction sensitizer can be used ranges from $1\times10^{-7}$ to $44\times10^{-6}$ mol. Further, JP-A-57-179835 describes that the appropriate addition amounts of thiourea dioxide and stannous chloride range from approximately 0.01 to approximately 2 mg and approximately 0.01 to approximately 3 mg, respectively, per mol of silver halide. Although the preferred addition amount of the ascorbic acid compound depends on factors such as the grain size and halogen composition of the emulsion and the temperature, pH and pAg at the preparation of the emulsion, it is preferred that the ascorbic acid compound be added in an amount selected from within the range of $5\times10^{-5}$ to $1\times10^{-1}$ mol, more preferably, $5\times10^{-4}$ to $1\times10^{-2}$ mol and, most preferably, $1\times10^{-3}$ to $1\times10^{-2}$ mol per mol of silver halide.

Each reduction sensitizer can be dissolved in water or any of solvents such as alcohols, glycols, ketones, esters and amides and added during the step of grain formation or before or after the chemical sensitization. Although the addition may be conducted at any of the steps of the emulsion producing process, it is preferred that the reduction sensitizer be added during the step of grain formation, especially, during the growth of host tabular grains. Although the reduction sensitizer may be put in a reaction vessel in advance, it is preferred that the addition be effected at an appropriate time during the grain formation. It is also suitable to add in advance the reduction sensitizer to an aqueous solution of a water-soluble silver salt or a water-soluble alkali halide and to perform grain formation with the use of the resultant aqueous solution. Alternatively, the reduction sensitizer solution may preferably be either divided and added a plurality of times in accordance with the grain formation or continuously added over a prolonged period of time.

An oxidizer capable of oxidizing silver is preferably used during the process of producing the silver halide grain emulsion formed through the step of growing silver halide grains by adding the silver iodide fine grain emulsion of the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H2O_2.2H_2O$), peroxy acid salts (e.g., $K_2S_2O_8$, $K_2C_2O_6$ and $K_2P_2O_8$), peroxy complex compounds (e.g., $K_2\{Ti(O_2)C_2O_4\}.3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates. Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones. The use of the silver oxidizer in combination with the above reduction sensitization is preferred. This combined use can be effected by performing the reduction sensitization after the use of the oxidizer or vice versa or by simultaneously performing the reduction sensitization and the use of the oxidizer. These methods can be selectively performed during the step of grain formation or the step of chemical sensitization.

Although the dispersion medium used during the process of producing the silver halide grain emulsion formed through the step of growing silver halide grains by adding the silver iodide fine grain emulsion of the present invention, is preferably gelatin, use also can be made of other hydrophilic polymeric compounds having protective colloid capability. For example, use can be made of proteins such as gelatin derivatives, graft polymers from gelatin and other polymers, albumin and casein; sugar derivatives, for example, cellulose derivatives such as hydroxyethylcellulose, carboxymethylcellulose and cellulose sulfate, sodium alginate and starch derivatives; and a variety of synthetic hydrophilic polymeric materials including homo- or copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

Suitable gelatins include, for example, not only lime treated gelatins but also acid treated gelatins and, further, enzyme treated gelatins as described in Bull. Soc. Sci. Photo. Japan, No. 16, p.30 (1966). Also, use can be made of gelatin hydrolyzates and enzymolyzates.

The silver halide grain emulsion formed through the step of growing silver halide grains by adding the silver iodide fine grain emulsion of the present invention is preferably washed with water for desalting and dispersed with the use of a newly provided dispersion medium having protective colloid capability. Although the water washing temperature can be selected in conformity with the object, it is preferably selected within the range of 5 to 50° C. Although the pH in which the water washing is conducted can also be selected in conformity with the object, it is preferably selected within the range of 2 to 10, more preferably, within the range of 3 to 8. Although the pAg in which the water washing is conducted can also be selected in conformity with the object, it is preferably selected within the range of 5 to 10. The method of water washing can be selected from among the noodle water washing technique, the dialysis with the use of a semipermeable membrane, the centrifugation, the coagulation precipitation method and the ion exchange method. The coagulation precipitation can be conducted according to a method selected from among the method in which a sulfate is used, the method in which an organic solvent is used, the method in which a water soluble polymer is used and the method in which a gelatin derivative is used.

Causing a salt of metal ion to be present during the preparation of the silver halide grain emulsion formed through the step of growing silver halide grains by adding the silver iodide fine grain emulsion of the present invention, for example, during the grain formation, desalting or chemical sensitization or prior to the coating is preferred depending on the object. In the doping of the grains, the metal ion salt is preferably added during the grain formation. In the modification of grain surface or the use as a chemical sensitizer, the metal ion salt is preferably added after the grain formation but before the completion of chemical sensitization. The entirety of the grains may be doped, or the doping may be locally performed, for example, only in the vicinity of the center or surface of the grains. Examples of suitable metals include Mg, Ca, Sr, Ba, Al, Sc, Y, La, Cr, Mn, Fe, Co, Ni, Cu, Zn, Ga, Ru, Rh, Pd, Re, Os, Ir, Pt. Au, Cd, Hg, Tl, In, Sn, Pb and Bi. These metals can be added as long as they are in the form of a salt soluble at the grain formation, such as an ammonium salt, an acetate, a nitrate, a sulfate, a phosphate, a hydroxide, a hexacoordination complex salt or a tetracoordination complex salt. For example, suitable examples of such salts include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. Coordination compound can be selected from among halo-, aquo-, cyano-, cyanate-, thiocyanate-, nitrosyl-, thionitrosyl-, oxo- and carbonyl-complexes. In these, use can be made of only one type of metal compound, or two types or at least three types thereof may be used in combination.

Each metal compound is preferably dissolved in water or a suitable solvent such as methanol or acetone before the addition thereof. The method in which an aqueous solution of a hydrogen halide (e.g., HCl or HBr) or an alkali halide (e.g., KCl, NaCl, KBr or NaBr) is added can be employed for stabilizing the solution. If necessary, an acid, an alkali or the like can be added to the solution. The metal compound can be placed either in the reaction vessel before the grain formation or during the grain formation. Further, the metal compound can be put in an aqueous solution of an alkali halide (e.g., NaCl, KBr or KI) or water-soluble silver salt (e.g., $AgNO_3$) and continuously added during the formation of silver halide grains. Still further, a solution separate from the aqueous solution of an alkali halide and a water-soluble silver salt may be provided and continuously added over an appropriate period of time during the grain formation. Moreover, various addition methods may preferably be combined.

It may be useful to employ the method in which a chalcogenide compound as described in U.S. Pat. No. 3,772,031 is added to the emulsion under preparation. Not only S, Se and Te but also a cyanate, a thiocyanate, selenocyanic acid, a carbonate, a phosphate and an acetate may be contained therein.

The silver halide grain emulsion formed through the step of growing silver halide grains by adding the silver iodide fine grain emulsion of the present invention can be provided with at least one of sulfur sensitization, selenium sensitization, noble metal sensitization such as gold or palladium sensitization and reduction sensitization in any of the steps of the process of producing the silver halide grain emulsion. Sensitization is preferably performed by a combination of these. Various types of emulsions can be prepared depending on in which of the steps the chemical sensitization is carried out. These include the type in which a chemical sensitization nucleus is implanted in an inner portion of the grains, the type in which the implantation is performed in a site shallow from the grain surface and the type in which the chemical sensitization nucleus is set in the grain surface. Although the position of the chemical sensitization nucleus can be selected depending on the object in the silver halide grain emulsion formed through the step of growing silver halide grains by adding the silver iodide fine grain emulsion of the present invention, it is generally preferred that at least one type of chemical sensitizing nucleus be provided in the vicinity of the grain surface.

A chemical sensitization which can preferably be carried out in the present invention is each or a combination of the chalcogenide sensitization and the noble metal sensitization. The chemical sensitization can be performed by the use of active gelatin as described in T. H. James, The Theory of the Photographic Process, 4th ed., Macmillan, 1977, p.p. 67–76. Also, the chemical sensitization can be performed by the use of a sensitizer selected from among sulfur, selenium, tellurium, gold, platinum, palladium, iridium and combinations thereof at a pAg of 5 to 10, a pH of 5 to 8 and a temperature of 30 to 80° C. as described in Research Disclosure, vol. 120, April 1974, 12008, Research Disclosure, vol. 34, June 1975, 13452, U.S. Pat. Nos. 2,642,361, 3,297,446, 3,772,031, 3,857,711, 3,901,714, 4,266,018 and 3,904,415 and GB 1,315,755. In the noble metal sensitization, use can be made of salts of noble metals such as gold, platinum, palladium and iridium and, especially, the gold sensitization, palladium sensitization and a combination thereof are preferred. In the gold sensitization, use can be made of customary compounds such as chloroauric acid, potassium chloroaurate, potassium auriothiocyanate, gold sulfide and gold selenide. The palladium compound means divalent and tetravalent palladium salts. Preferred palladium compounds are represented by the formula:

$$R_2PdX_6 \text{ or } R_2PdX_4$$

wherein R is a hydrogen atom, an alkali metal atom or an ammonium group and X is a halogen atom selected from among chlorine, bromine and iodine atoms.

Specifically, preferred use is made of $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$. The gold compound and palladium compound are preferably used in combination with a thiocyanate salt or a selenocyanate salt.

Suitable sulfur sensitizers include hypo, thiourea compounds, rhodanine compounds and sulfurous compounds described in U.S. Pat. Nos. 3,857,711, 4,266,018 and 4,054,457. Chemical sensitization can be effected in the presence of a chemical sensitization auxiliary commonly so termed. Suitable chemical sensitization auxiliaries are compounds capable of inhibiting fog in the course of chemical sensitization and capable of increasing sensitivity, such as azaindene, azapyridazine and azapyrimidine. Examples of chemical sensitization auxiliary modifiers are set forth in U.S. Pat. Nos. 2,131,038, 3,411,914 and 3,554,757, JP-A-58-126526 and the above Duffin, "Chemistry of Photographic Emulsion", p.p. 138–143.

In the silver halide grain emulsion formed through the step of growing silver halide grains by adding the silver iodide fine grain emulsion of the present invention, sensitization is preferably performed in combination with the gold sensitization. The amount of gold sensitizer is preferably in the range of $1\times10^{-4}$ to $1\times10^{-7}$ mol, more preferably, $1\times10^{-5}$ to $5\times10^{-7}$ mol per mol of silver halide. The amount of palladium compound is preferably in the range of $1\times10^{-3}$ to $5\times10^{-7}$ mol per mol of silver halide. The amount of thiocyanate compound or selenocyanate compound is preferably in the range of $5\times10^{-2}$ to $1\times10^{-6}$ mol per mol of silver halide. The amount of sulfur sensitizer is preferably in the range of $1\times10^{-4}$ to $1\times10^{-7}$ mol, more preferably, $1\times10^{-5}$ to $5\times10^{-7}$ mol per mol of silver halide.

Selenium sensitization can be mentioned as means for enabling a suitable sensitization of the silver halide grain emulsion formed through the step of growing silver halide grains by adding the silver iodide fine grain emulsion of the present invention. In the selenium sensitization, use can be made of conventional unstable selenium compounds, for example, colloidal metal selenium, selenoureas (e.g., N,N-dimethylselenourea and N,N-diethylselenourea), selenoketones, selenoamides and other selenium compounds. Although the addition amount of the selenium compound depends on varied conditions, it is preferably in the range of $1\times10^{-3}$ to $5\times10^{-5}$ mol per mol of silver halide. It may be preferred to employ the selenium sensitization in combination with the sulfur sensitization or noble metal sensitization or both.

The silver halide grain emulsion formed through the step of growing silver halide grains by adding the silver iodide fine grain emulsion of the present invention can be doped with various compounds for the purpose of preventing fogs during the process for producing a lightsensitive material or during the storage or photographic processing thereof or for the purpose of stabilizing the photographic performance. That is, the silver halide grain emulsion can be doped with various compounds known as antifoggants or stabilizers, including thiazoles (e.g., benzothiazolium salts), nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nirobenzotriazoles, mercaptotetrazoles (especially, 1-phenyl-5-mercaptotetrazole), mercaptopyrimidines, mercaptotriazines (e.g., thioketo compounds such as oxazolinethione), and azaindenes such as triazaindenes, tetraazaindenes (especially, 4-hydroxy substituted (1,3,3a,7)tetraazaindenes) and pentaazaindenes. For example, use can be made of those described in U.S. Pat. Nos. 3,954,474 and 3,982,947 and JP-B-52-28660. Preferred compound is described in JP-A-63-212932. The doping with the antifoggant or stabilizer can be effected at a varied time, for example, before, during or after the grain formation, during the washing with water, during the dispersion after the water washing, before, during or after the chemical sensitization, or before the coating in accordance with the purpose. The doping during emulsion preparation can be performed not only for the above exertion of primary fog prevention and stabilizing effects but also for a multiplicity of other purposes including control of the crystal wall of grains, decrease of the grain size, lowering of the grain solubility, control of the chemical sensitization and control of the dye arrangement.

The silver halide grain emulsion formed through the step of growing silver halide grains by adding the silver iodide fine grain emulsion of the present invention is preferably subjected to a spectral sensitization with a methine dye or the like. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have carbon atoms substituted.

Any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GB 1,344,281 and 1,507,803, JP-B-43-4936 and 53-12375 and JP-A-52-110618 and 52-109925.

The emulsion of the present invention may contain a dye which itself exerts no spectral sensitizing effect or a substance which absorbs substantially none of visible radiation and exhibits supersensitization, together with the above spectral sensitizing dye.

The spectral sensitizing dye may be added at any stage of the process for preparing the emulsion which is known as being useful. Although the addition is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

The addition amount of the spectral sensitizing dye can range from $4\times10^{-6}$ to $8\times10^{-3}$ mol per mol of silver halide. When the silver halide grain size is in the preferred range of 0.2 to 1.2 $\mu$m, the addition amount more preferably ranges from approximately $5\times10^{-5}$ to $2\times10^{-3}$ mol per mol of silver halide.

The emulsion of the present invention can be used in, for example, a blue-sensitive layer, a green-sensitive layer or a red-sensitive layer of a silver halide color photographic lightsensitive material. The emulsion of the present invention can also be used in a black-and-white photographic lightsensitive material.

The above various additives can be used in the lightsensitive material according to the present technology, to which other various additives can also be added in conformity with the object.

The additives are described in detail in Research Disclosure Item 17643 (December 1978), Item 18716 (November 1979) and Item 308119 (December 1989), the disclosures of which are herein incorporated by reference. Individual particulars and the locations where they are described will be listed below.

| | Types of additives | RD17643 | RD18716 | RD308119 |
|---|---|---|---|---|
| 1 | Chemical sensitizers | page 23 | page 648 right column | page 996 |
| 2 | Sensitivity increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column |

The silver halide grain emulsion produced through the step of growing silver halide grains by adding the silver iodide fine grain emulsion of the present invention, and layer arrangement and related techniques, silver halide emulsions, dye forming couplers, DIR couplers and other functional couplers, various additives and development processing which can be used in the photographic lightsensitive material including the emulsion are described in EP 0565096A1 (published on Oct. 13, 1993) and patents cited therein, the disclosure of which are herein incorporated by reference. Individual particulars and the locations where they are described will be listed below.

1. Layer construction: page 61 lines 23 to 35, page 61 line 41 to page 62 line 14,
2. Interlayers: page 61 lines 36 to 40,
3. Interlayer effect imparting layers: page 62 lines 15 to 18,
4. Halogen compositions of silver halide: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42, 9. Tabular grains: page 62 lines 43 to 46,
10. Internal structures of grains: page 62 lines 47 to 53,
11. Latent image forming types of emulsions: page 62 line 54 to page 63 to line 5,12. Physical ripening and chemical ripening of emulsion: page 63 lines 6 to 9,
13. Emulsion mixing: page 63 lines 10 to 13,
14. Fogged emulsions: page 63 lines 14 to 31,
15. Non-lightsensitive emulsions: page 63 lines 32 to 43,
16. Amounts of coated silver: page 63 lines 49 to 50,
17. Photographic additives: The additives are described in Research Disclosure (RD) Item 17643 (December 1978), Item 18716 (November 1979) and Item 307105 (November 1989), the disclosures of which are herein incorporated by reference. Individual particulars and the locations where they are described will be listed below.

| | Types of additives | RD17643 | RD18716 | RD307105 |
|---|---|---|---|---|
| 1 | Chemical sensitizers | page 23 | page 648 right column | page 866 |
| 2 | Sensitivity increasing agents | | page 648 right column | |
| 3 | Spectral sensitizers, super-sensitizers | pages 23–24 | page 648, right column to page 649, right column | pages 866–868 |
| 4 | Brighteners | page 24 | page 647, right column | page 868 |
| 5 | Antifoggants, stabilizers | pages 24–25 | page 649 right column | pages 868–870 |
| 6 | Light absorbents, filter dyes, ultraviolet absorbents | pages 25–26 | page 649, right column to page 650, left column | page 873 |
| 7 | Stain preventing agents | page 25, right column | page 650, left to right columns | page 872 |
| 8 | Dye image stabilizers | page 25 | page 650, left column | page 872 |
| 9 | Film hardeners | page 26 | page 651, left column | pages 874–875 |
| 10 | Binders | page 26 | page 651, left column | pages 873–874 |
| 11 | Plasticizers, lubricants | page 27 | page 650, right column | page 876 |
| 12 | Coating aids, surfactants | pages 26–27 | page 650, right column | pages 875–876 |
| 13 | Antistatic agents | page 27 | page 650, right column | pages 876–877 |
| 14 | Matting agents | | | pages 878–879 |

18. Formaldehyde scavengers: page 64 lines 54 to 57,
19. Mercapto antifoggants: page 65 lines 1 to 2,
20. Fogging agent, etc. releasing agents: page 65 lines 3 to 7,
21. Dyes: page 65, lines 7 to 10,
22. Color coupler in general: page 65 lines 11 to 13,
23. Yellow, magenta and cyan couplers: page 65 lines 14 to 25,
24. Polymer couplers: page 65 lines 26 to 28,
25. Diffusive dye forming couplers: page 65 lines 29 to 31,
26. Colored couplers: page 65 lines 32 to 38,
27. Functional coupler in general: page 65 lines 39 to 44,
28. Bleaching accelerator releasing couplers: page 65 lines 45 to 48,
29. Development accelerator releasing couplers: page 65 lines 49 to 53,
30. Other DIR couplers: page 65 line 54 to page 66 to line 4,
31. Method of dispersing couplers: page 66 lines 5 to 28,
32. Antiseptic and mildewproofing agents: page 66 lines 29 to 33,
33. Types of sensitive materials: page 66 lines 34 to 36,
34. Thickness of lightsensitive layer and swelling velocity: page 66 line 40 to page 67 line 1,
35. Back layers: page 67 lines 3 to 8,
36. Development processing in general: page 67 lines 9 to 11,
37. Developers and developing agents: page 67 lines 12 to 30,
38. Developer additives: page 67 lines 31 to 44,
39. Reversal processing: page 67 lines 45 to 56,
40. Processing solution aperture ratio: page 67 line 57 to page 68 line 12,
41. Development time: page 68 lines 13 to 15,
42. Bleach-fix, bleaching and fixing: page 68 line 16 to page 69 line 31,
43. Automatic processor: page 69 lines 32 to 40,
44. Washing with water, rinse and stabilization: page 69 line 41 to page 70 line 18,
45. Processing solution replenishment and recycling: page 70 lines 19 to 23,
46. Containment of developing agent in sensitive material: page 70 lines 24 to 33,
47. Development processing temperature: page 70 lines 34 to 38, and
48. Application to film with lens: page 70 lines 39 to 41.

Moreover, preferred use can be made of a bleaching solution containing 2-pyridinecarboxylic acid or 2,6-pyridinedicarboxylic acid, a ferric salt such as ferric nitrate and a persulfate as described in EP 602,600, the disclosure of which is herein incorporated by reference. When this bleaching solution is used, it is preferred that the steps of stop and water washing be conducted between the steps of color development and bleaching. An organic acid such as acetic acid, succinic acid or maleic acid is preferably used as a stop solution. For pH adjustment and bleaching fog, it is preferred that the bleaching solution contain an organic acid such as acetic acid, succinic acid, maleic acid, glutaric acid or adipic acid in an amount of 0.1 to 2 mol/L.

EXAMPLES

The present invention will be described in more detail below by way of its examples. However, the present invention is not limited to these examples.

Example 1

This Example illustrates that the aggregation behavior which occurs when a silver iodide fine grain emulsion with a high silver halide concentration is stored in a dissolved state or in a refrigerated and set state can favorably be reduced by the use of the silver iodide fine grain emulsion according to the present invention.

The gelatin-1, -2 and -3 used as a dispersion medium in the following preparation of silver iodide fine grain emulsion have the following characteristics:

gelatin-1: common alkali-treated ossein gelatin prepared from bullock bone as a raw material, having a methionine residue content of 78 μmol/g, and containing —$NH_2$ groups which are not chemically modified;

gelatin-2: gelatin obtained by adding $H_2O_2$ to an aqueous solution of gelatin-1 at 40° C. and at a pH value of 6.0 to thereby effect a chemical reaction, removing remaining $H_2O_2$ and drying, having a methionine residue content of 16 μmol/g, and containing —$NH_2$ groups which are not chemically modified; and gelatin-3: gelatin obtained by adding phthalic anhydride to an aqueous solution of gelatin-1 at 50° C. and at a pH value of 9.0 to thereby effect a chemical reaction, removing remaining phthalic acid and drying, having a methionine residue content of 78 μmol/g, and containing —$NH_2$ groups whose 95% are chemically modified. In the examples, each ratio of the chemical modification of —$NH_2$ groups was determined by the before mentioned formal titration method, described in "The Science and Technology of Gelatin", Chapter 15, Academic Press, 1997.

Each of the above gelatin-1, -2, and -3 were adjusted so that the pH value exhibited by a 5% aqueous solution thereof at 35° C was 6.0 and that the electric conductivity exhibited by a 2% aqueous solution thereof at 25° C. was 300 μS/cm.

(Preparation of comparative silver iodide fine grain emulsion AGI-0)

1700 mL (milliliter) of an aqueous solution containing 0.23g of KI and 29.5g of gelatin-1 was maintained at 40° C. and agitated. An aqueous solution of $AgNO_3$ (220 g) and an aqueous solution of KI (216.5 g) were added by the double jet method over a period of 20 min. Thus, fine grains of silver iodide were formed. Thereafter, an aqueous solution of WF (2.5 g) set forth below was added. The WF is a mixture of the compounds set forth below wherein n=2 to 9.

WF

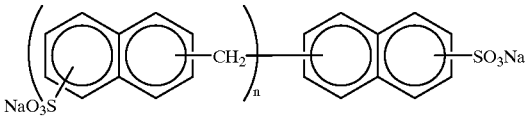

*n*:2-9

A desalting was performed by the usual flocculation method in which the pH was adjusted to 3.9 by addition of $H_2SO_4$ to thereby effect coagulation precipitation and resultant supernatant was removed to thereby effect desalting. The desalting was so performed that a water washing ratio of 100 was attained. Thereafter, water, NaOH and gelatin-1 were added under agitation and adjusted to a pH value of 6.0 at 40° C. The thus prepared silver iodide fine grain emulsion AGI-0 contained per liter 0.45 mol of fine grains of silver iodide having an average grain size of 0.044 μm and a variation coefficient of grain size distribution of 15%, further contained 40.0 g of gelatin per liter of emulsion and exhibited an electric conductivity at 40° C. of 2,150 μS/cm and a specific gravity of 1.098.

(Preparation of comparative silver iodide fine grain emulsions AGI-1 and -2)

Silver iodide fine grain emulsion AGI-1 was prepared in the same manner as in the preparation of silver iodide fine grain emulsion AGI-0, except for the following changes. Namely, the silver iodide fine grain formation was conducted in exactly the same manner as in the preparation of emulsion AGI-0. However, the desalting by the flocculation method after the silver iodide fine grain formation was conducted so that a water washing ratio of 180 was attained, and the amounts of water and gelatin-1 added after the step of desalting were changed so that the content of fine grains of silver iodide per liter of emulsion was 0.83 mol and that the gelatin content per liter of emulsion was 40.0 g. Silver iodide fine grain emulsion AGI-1 was obtained by adjustment to a pH value of 6.0 at 40° C. The silver iodide fine grains of AGI-1 had the same grain size and grain size distribution variation coefficient as those of emulsion AGI-0. The electric conductivity at 40° C. thereof was 2,010 μS/cm and the specific gravity was 1.172.

Furthermore, silver iodide fine grain emulsion AGI-2 was prepared in the same manner as in the preparation of the silver iodide fine grain emulsion AGI-1, except that the desalting by the flocculation method after the silver iodide fine grain formation was conducted so that the attained water washing ratio was changed to 100. The silver iodide fine grains of AGI-2 had the same grain size and grain size distribution variation coefficient as those of emulsion AGI-0. The electric conductivity at 40° C. thereof was 3,080 μS/cm, and the specific gravity thereof was approximately identical to that of emulsion AGI-1.

(Preparation of silver iodide fine grain emulsions AGI-3 to -5 according to the present invention)

Silver iodide fine grain emulsions AGI-3 to -5 were prepared in the same manner as in the preparation of the silver iodide fine grain emulsion AGI-1, except that the desalting by the flocculation method after the silver iodide fine grain formation was conducted so that the attained water washing ratio was changed to 43, 11 and 7.5, respectively. The silver iodide fine grains of AGI-3 to -5 had the same grain size and grain size distribution variation coefficient as those of emulsion AGI-0. The electric conductivities at 40° C. thereof were 4,950, 10,130 and 14,050 μS/cm, respectively, and the specific gravities thereof were approximately identical to that of emulsion AGI-1.

(Preparation of comparative silver iodide fine grain emulsion AGI-6)

Silver iodide fine grain emulsion AGI-6 was prepared in the same manner as in the preparation of the silver iodide fine grain emulsion AGI-1, except that the desalting by the flocculation method after the silver iodide fine grain formation was conducted so that the attained water washing ratio was changed to 5.0. The silver iodide fine grains of AGI-6 had the same grain size and grain size distribution variation coefficient as those of emulsion AGI-0. The electric conductivity at 40° C. thereof was 18,910 μS/cm, and the specific gravity thereof was approximately identical to that of emulsion AGI-1.

(Preparation of silver iodide fine grain emulsions AGI-7 and -8 according to the present invention)

Silver iodide fine grain emulsions AGI-7 and -8 were prepared in the same manner as in the preparation of the silver iodide fine grain emulsion AGI-4, except that the gelatin-1 used for the silver iodide fine grain formation was changed to an equal weight of gelatin-2 and an equal weight of gelatin-3, respectively. The silver iodide fine grains of AGI-7 and -8 had approximately the same average grain size as that of emulsion AGI-0, i.e., 0.044 μm and had grain size variation coefficients of 14 and 16%, respectively. The specific gravities at 40° C. thereof were approximately identical to that of emulsion AGI-1 and the electric conductivities thereof were 10,150 and 10,100 μS/cm, respectively.

(Preparation of comparative silver iodide fine grain emulsion AGI-9)

Silver iodide fine grain emulsion AGI-9 was prepared in the same manner as in the preparation of silver iodide fine grain emulsion AGI-0, except for the following changes. Namely, the silver iodide fine grain formation was conducted in exactly the same manner as in the preparation of emulsion AGI-0. However, the desalting by the flocculation method after the silver iodide fine grain formation was conducted so that a water washing ratio of 140 was attained, and the amounts of water and gelatin-1 added after the step of desalting were changed so that the content of fine grains of silver iodide per liter of emulsion was 0.62 mol and that the gelatin content per liter of emulsion was 40.0 g. Silver iodide fine grain emulsion AGI-9 was obtained by adjustment to a pH value of 6.0 at 40° C. The silver iodide fine grains of AGI-9 had the same grain size and grain size distribution variation coefficient as those of emulsion AGI-0. The electric conductivity at 40° C. thereof was 2,100 μS/cm and the specific gravity was 1.131.

(Preparation of silver iodide fine grain emulsion AGI-10 according to the present invention)

Silver iodide fine grain emulsion AGI-10 was prepared in the same manner as in the preparation of the silver iodide fine grain emulsion AGI-9, except that the desalting by the flocculation method after the silver iodide fine grain formation was conducted so that the attained water washing ratio was changed to 8.6. The silver iodide fine grains of AGI-10 had the same grain size and grain size distribution variation coefficient as those of emulsion AGI-0. The electric conductivity at 40° C. thereof was 10,030 μS/cm, and the specific gravity thereof was approximately identical to that of emulsion AGI-9.

(Preparation of comparative silver iodide fine grain emulsion AGI-11)

Silver iodide fine grain emulsion AGI-11 was prepared in the same manner as in the preparation of the silver iodide fine grain emulsion AGI-9, except that the desalting by the flocculation method after the silver iodide fine grain formation was conducted so that the attained water washing ratio was changed to 6.0. The silver iodide fine grains of AGI-11 had the same grain size and grain size distribution variation coefficient as those of emulsion AGI-0. The electric conductivity at 40° C. thereof was 18,100 μS/cm, and the specific gravity thereof was approximately identical to that of emulsion AGI-9.

The degree of aggregation of silver iodide fine grains, which occurred by storing in a dissolved state or in a refrigerated and set state, was evaluated by the following method. With respect to each silver iodide fine grain emulsion, the evaluation was conducted by measuring the pressures applied when a sample stored in a 50° C., dissolved state for 6 hr, another sample stored in a 35° C., dissolved state for 30 days, a third sample stored in a 10° C., set state for 120 days and a control sample prior to storage initiation, the control sample being in a 40° C., dissolved state, were filtered through a polypropylene nonwoven fabric filter (average pore size: 3 μm and thickness: 0.5 mm) produced by Fuji Photo Film Co., Ltd. Illustratively, the pressure to be applied to each sample emulsion when filtering it through the above filter with a diameter of 10 mm at a flow rate of 25 mL/min was measured at the time of filtration of 50 mL of the emulsion (pressure at that time referred to as "$P_{50}$") and at the time of filtration of 500 mL of the emulsion (pressure at that time referred to as "$P_{500}$"). It was judged that, the greater the value of $\Delta P = P_{500} - P_{50}$, the greater the degree of aggregation of silver iodide fine grains. The reason is that the value of Δ P would be increased by sticking of aggregates to the filter at the filtration and resultant reduction of the effective sectional area for passage of the filter.

Evaluation results of the above degree of aggregation of silver iodide fine grains are given in Table 1.

TABLE 1

| | Characteristics of AgI fine grain emulsion | | | $\Delta P = P_{500} - P_{50}$ (kg/cm$^2$)*2 AgI fine grain emulsion used | | | |
|---|---|---|---|---|---|---|---|
| Sample (Remarks) | AgI content/L of emulsion (mol; 40° C.) | Electric conductivity (μS/cm; 40° C.) | Gelatin used during grain formation *1 | Immediatley after preparation | After storage in dissolved state 50° C./6 H | After storage in dissolved state; 35° C./30 D | After storage in set state; 10° C./120 D |
| AGI-0 (Comp.) | 0.45 | 2150 | Gelatin-1 | 0.02 | 0.15 | 0.26 | 0.12 |
| AGI-1 (Comp.) | 0.83 | 2010 | Gelatin-1 | 0.35 | 3.30 | >4.0 (beyond measurement limitation) | 2.50 |
| AGI-2 (Comp.) | 0.83 | 3080 | Gelatin-1 | 0.20 | 1.80 | 2.10 | 1.20 |
| AGI-3 (Inv.) | 0.83 | 4950 | Gelatin-1 | 0.07 | 0.15 | 0.31 | 0.10 |
| AGI-4 (Inv.) | 0.83 | 10130 | Gelatin-1 | 0.03 | 0.10 | 0.21 | 0.07 |
| AGI-5 (Inv.) | 0.83 | 14050 | Gelatin-1 | 0.04 | 0.19 | 0.25 | 0.09 |
| AGI-6 (Comp.) | 0.83 | 18910 | Gelatin-1 | 0.10 | 1.20 | 1.40 | 0.41 |
| AGI-7 (Inv.) | 0.83 | 10150 | Gelatin-2 | 0.03 | 0.05 | 0.12 | 0.06 |
| AGI-8 (Inv.) | 0.83 | 10100 | Gelatin-3 | 0.03 | 0.05 | 0.15 | 0.04 |
| AGI-9 (Comp.) | 0.62 | 2100 | Gelatin-1 | 0.22 | 1.90 | 2.90 | 1.50 |
| AGI-10 (Inv.) | 0.62 | 10030 | Gelatin-1 | 0.03 | 0.08 | 0.18 | 0.06 |
| AGI-11 (Comp.) | 0.62 | 18100 | Gelatin-1 | 0.09 | 1.10 | 1.30 | 0.40 |

Note

*1) Gelatin-1: conventional alkali-treated ossein gelatin; Gelatin-2: gelatin with low methionine content; Gelatin-3: gelatin with chemically modified —$NH_2$ groups.

*2) Aggregation degree of AgI fine grain is evaluated by the difference: (filtration pressure after 500 mL of emulsion is filtered) − (filtration pressure after 50 mL of emulsion is filtered).

As apparent from Table 1, when the content of silver iodide fine grains per liter of emulsion is increased from 0.45 mol to at least 0.62 mol under such conditions that the electric conductivity of the emulsion in a 40° C., dissolved state ranges from 2,000 to 2,200 μS/cm, the degree of increase of the value of Δ P attributed to storage in a dissolved state or in a refrigerated and set state is made greater, thereby indicating an increased tendency of silver iodide fine grains to aggregate. A difference in Δ P also recognized in comparison of emulsions immediately after preparation would be a difference in the degree of aggregation behavior of silver iodide fine grains which, even if slightly, occurs in the step of dispersing silver iodide fine grains by adding water, NaOH and gelatin after desalting. With respect to the silver iodide fine grain emulsions according to the present invention, namely, the emulsion samples exhibiting an electric conductivity of 4,500 to 15,000 μS/cm in a 40° C. dissolved state, the degree of increase of the value of Δ P attributed to storage in a dissolved state or in a refrigerated and set state is slight despite the increase of content of silver iodide fine grains per liter of emulsion to 0.83 mol, thereby indicating that the degree of aggregation behavior of silver iodide fine grains is slight. Moreover, it is apparent from the results of Table 1 that the above aggregation behavior is preferably further reduced by changing the gelatin used in the steps from grain formation to completion of desalting from gelatin-1, which is common alkali-treated ossein gelatin, to gelatin-2 being gelatin with a low methionine residue content or to gelatin-3 being gelatin whose $-NH_2$ groups are chemically modified.

Example 2

This Example demonstrates that the performance of the lightsensitive silver halide emulsion is enhanced by changing the step of growing a silver halide containing silver iodide in the process of grain formation of the lightsensitive silver halide emulsion. Specifically, this Example demonstrates that the performance is enhanced by changing the step of growing the method in which an aqueous solution of halide containing iodide ions and an aqueous solution of silver salt are added according to the double jet technique, to the method in which a silver iodide fine grain emulsion is added. Furthermore, this Example demonstrates that, on the base that the method in which a silver iodide fine grain emulsion is added is superior, the greater the degree of aggregation of silver iodide fine grains, the greater the deterioration of the performance of the lightsensitive silver halide emulsion. In addition to these, this Example demonstrates that the silver iodide fine grain emulsion of the present invention exhibits a low degree of aggregation of silver iodide fine grains when stored in a dissolved state or in a refrigerated and set state, so that the performance of the lightsensitive silver halide emulsion is not deteriorated.

(Preparation of comparative emulsion AN)

1,200 mL of an aqueous solution containing 3.40 g, in terms of the amount of silver, of a seed emulsion composed of tabular silver bromide grains having an average equivalent sphere diameter of 0.24 μm and an average aspect ratio of 6.0, 0.40 g of kBr, 6 mg of sodium benzenethiosulfonate and 45 g of gelatin-3 described in Example 1 was heated at 75° C. and agitated [preparation of the first solution]. An aqueous solution of $AgNO_3$ (25.3 g) and a 20% by weight aqueous solution of KBr were added, while increasing the flow rate, according to a double jet method over a period of 9.5 min. During this period, the silver potential against saturation calomel electrode was maintained at −25 mV [addition 1]. Subsequently, an aqueous solution of $AgNO_3$ (88.0 g) and a halide aqueous solution containing 2.0% by weight of KI and 14.2% by weight of KBr were added, while increasing the flow rate, according to a double jet method over a period of 23.5 min. During this period, the silver potential against saturation calomel electrode was maintained at −25 mV [addition 2]. Then, an aqueous solution of $AgNO_3$ (41.8 g) and a 20% by weight aqueous solution of KBr were added according to a double jet method over a period of 10.5 min. During this period, the silver potential against saturation calomel electrode was maintained at +20 mV [addition 3]. Thereafter, the silver potential against saturation calomel electrode was adjusted to −72 mV by addition of a 25% by weight aqueous solution of KBr [addition 4]. Next, an aqueous solution of $AgNO_3$ (5.86 g) and an aqueous solution of KI (6.4 g) (adjusted to 3.0% by weight) were added according to a double jet method over a period of 5 min [addition 5]. Further, an aqueous solution of $AgNO_3$ (66.5 g) and a 23% by weight aqueous solution of KBr were added according to a double jet method. The aqueous solution of $AgNO_3$ was added over a period of 7 min. On the other hand, the aqueous solution of KBr was added only for first 3.7 min so that the silver potential against saturation calomel electrode was maintained at −72 mV and was not added for the rest of 3.3 min so that the silver potential increased from −72 mV to −37 mV [addition 6]. Thereafter, desalting was performed according to the usual flocculation method, and water, NaOH and gelatin-1 described in Example 1 were added under agitation so that the pH and pAg at 40° C. were adjusted to 6.4 and 8.8, respectively. The electric conductivity was adjusted to 3,000 μS/cm. The temperature of the thus prepared emulsion was controlled at 56° C., and iridium dipotassium hexachloride, spectral sensitizing dyes I to III of the formulae:

Sensitizing dye I

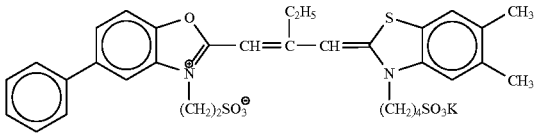

Sensitizing dye II

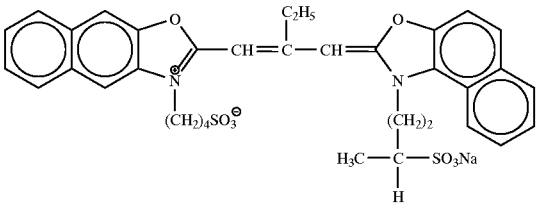

Sensitizing dye III

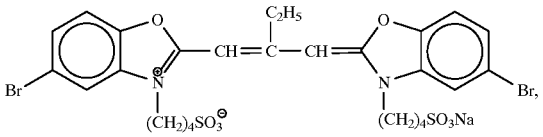

potassium thiocyanate, chloroauric acid, sodium thiosulfate and N,N-dimethylselenourea were added, thereby effecting optimum chemical sensitization. The optimum chemical sensitization herein means that the 1/100 sec sensitivity of the coated sample becomes the maximum.

The thus prepared emulsion was designated emulsion AN. The emulsion AN was composed of tabular grains having an average equivalent circular diameter of 1.43 μm, a variation coefficient of equivalent circular diameter of 23.5%, an average thickness of 0.20 μm, an average aspect ratio of 7.2 and an average equivalent sphere diameter of 0.85 μm. The grains having an aspect ratio of at least 5 occupied 90% or more of the total projected area.

(Preparation of comparative emulsion BN)

Emulsion BN was prepared in the same manner as in the preparation of emulsion AN, except for the following changes. In the addition 2, a 15.6% by weight aqueous solution of KBr was used as the halide aqueous solution, and 105.3 mL of silver iodide fine grain emulsion AGI-0 of Example 1 in a dissolved state at 40° C. was added, while increasing the flow rate, simultaneously with the addition of the aqueous solution of $AgNO_3$ and aqueous solution of KBr according to the double jet method over a period of 23.5 min. In the addition 5, the addition of the aqueous solution of $AgNO_3$ and aqueous solution of KI according to the double jet method was changed to addition of 85.6 mL of silver iodide fine grain emulsion AGI-0 of Example 1 in a dissolved state at 40° C. over a period of 15 sec. The emulsion grains of the emulsion BN prepared by the above modified process were composed of tabular grains having approximately the same grain size and configuration as those of the emulsion grains of the emulsion AN.

In this Example, four sets of the above emulsion BN and four sets of the following emulsions CN to JN were prepared with the use of silver iodide fine grains that were held under one of the following four conditions, respectively:

(i) immediately after preparation of silver iodide fine grain emulsion, (ii) stored in a 50° C., dissolved state for 6 hr, (iii) stored in a 35° C., dissolved state for 30 days, and (iv) stored in a 10° C., set state for 120 days.

(Preparation of comparative emulsions CN and DN)

Emulsion CN was prepared in the same manner as in the preparation of emulsion AN, except for the following changes. In the addition 2, a 15.6% by weight aqueous solution of KBr was used as the halide aqueous solution, and 57.1 mL of silver iodide fine grain emulsion AGI-1 of Example 1 in a dissolved state at 40° C. was added, while increasing the flow rate, simultaneously with the addition of the aqueous solution of $AgNO_3$ and aqueous solution of KBr according to the double jet method over a period of 23.5 min. In the addition 5, the addition of the aqueous solution of $AgNO_3$ and aqueous solution of KI according to the double jet method was changed to addition of 46.4 mL of silver iodide fine grain emulsion AGI-1 of Example 1 in a dissolved state at 40° C. over a period of 15 sec. The emulsion grains of the emulsion CN prepared by the above modified process were composed of tabular grains having approximately the same grain size and configuration as those of the emulsion grains of the emulsion AN.

Furthermore, emulsion DN was prepared in the same manner as in the preparation of emulsion CN, except that each of the silver iodide fine grain emulsion AGI-1 was replaced by the same weight of silver iodide fine grain emulsion AGI-2 of Example 1. The emulsion grains of the emulsion DN were composed of tabular grains having approximately the same grain size and configuration as those of the emulsion grains of the emulsion AN.

(Preparation of emulsions EN to GN according to the present invention)

Emulsion EN was prepared in the same manner as in the preparation of emulsion CN, except that the silver iodide fine grain emulsion AGI-1 was replaced in each occasion by the same weight of silver iodide fine grain emulsion AGI-3 of Example 1.

Emulsion FN was prepared in the same manner as in the preparation of emulsion CN, except that the silver iodide fine grain emulsion AGI-1 was replaced in each occasion by the same weight of silver iodide fine grain emulsion AGI-4 of Example 1.

Emulsion GN was prepared in the same manner as in the preparation of emulsion CN, except that the silver iodide fine grain emulsion AGI-1 was replaced in each occasion by the same weight of silver iodide fine grain emulsion AGI-5 of Example 1.

The emulsion grains of the emulsions EN to GN were composed of tabular grains having approximately the same grain size and configuration as those of the emulsion grains of the emulsion AN.

(Preparation of comparative emulsion HN)

Emulsions HN was prepared in the same manner as in the preparation of emulsion CN, except that each of the silver iodide fine grain emulsion AGI-1 was replaced by the same weight of silver iodide fine grain emulsions AGI-6 of Example 1. The emulsion grains of the emulsion HN were composed of tabular grains having approximately the same grain size and configuration as those of the emulsion grains of the emulsion AN.

(Preparation of emulsions IN and JN according to the present invention)

Emulsion IN was prepared in the same manner as in the preparation of emulsion CN, except that the silver iodide fine grain emulsion AGI-1 was replaced in each occasion by the same weight of silver iodide fine grain emulsion AGI-7 of Example 1.

Emulsion JN was prepared in the same manner as in the preparation of emulsion CN, except that the silver iodide fine grain emulsion AGI-1 was replaced in each occasion by the same weight of silver iodide fine grain emulsion AGI-8 of Example 1.

The emulsion grains of the emulsions IN and JN were composed of tabular grains having approximately the same grain size and configuration as those of the emulsion grains of the emulsion AN.

The emulsions AN to MN were observed by a 400 kV transmission electron microscope at a liquid nitrogen temperature, and it was found that at least 10 dislocation lines were present in the vicinity of the periphery of tabular grains of all the emulsion grains.

A cellulose triacetate film support with a subbing layer was coated with each of the above emulsions AN to MN and provided with a protective layer under the coating conditions specified in Table 2, thereby obtaining samples.

Table 2

(1) Emulsion layer

Emulsion: Each of Emulsions AN to MN ($2.1\times10^{-2}$ mol/m$^2$, in terms of Ag)

Coupler set forth below:

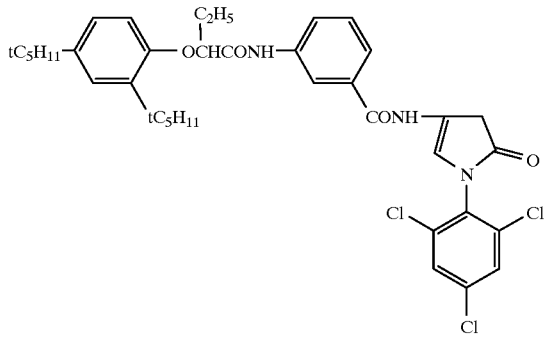

| | |
|---|---|
| | ($1.5\times10^{-3}$ mol/m$^2$) |
| Tricresyl phosphate | (1.10 g/m$^2$) |
| Gelatin | (2.30 g/m$^2$) |
| (2) Protective layer | |
| 2,4-Dichloro-6-hydroxy-s-triazine sodium salt | (0.08 g/m$^2$) |
| Gelatin | (1.80 g/m$^2$) |

The samples were hardened at 40° C. in a relative humidity of 70% for 14 hr. Thereafter, exposure was conducted through gelatin filter SC-50 produced by Fuji Photo Film Co., Ltd. and a continuous wedge. For evaluating reciprocity characteristics, exposure intensity was adjusted so as to ensure the same amount of exposure and exposure was conducted for 1/100 sec.

(Preparation of comparative emulsion KN)

Emulsion KN was prepared in the same manner as in the preparation of emulsion AN, except for the following changes. In the addition 2, a 15.6% by weight aqueous solution of KBr was used as the halide aqueous solution, and 76.4 mL of silver iodide fine grain emulsion AGI-9 of Example 1 in a dissolved state at 40° C. was added, while increasing the flow rate, simultaneously with the addition of the aqueous solution of $AgNO_3$ and aqueous solution of KBr according to the double jet method over a period of 23.5 min. In the addition 5, the addition of the aqueous solution of $AgNO_3$ and aqueous solution of KI according to the double jet method was changed to emulsification of 62.1 mL of silver iodide fine grain emulsion AGI-9 of Example 1 in a dissolved state at 40° C. over a period of 15 sec. The emulsion grains of the emulsion KN prepared by the above modified process were composed of tabular grains having approximately the same grain size and configuration as those of the emulsion grains of the emulsion AN.

(Preparation of emulsion LN according to the present invention)

Emulsion LN was prepared in the same manner as in the preparation of emulsion KN, except that the silver iodide fine grain emulsion AGI-9 was replaced in each occasion by the same weight of silver iodide fine grain emulsion AGI-10 of Example 1. The emulsion grains of the emulsion LN were composed of tabular grains having approximately the same grain size and configuration as those of the emulsion grains of the emulsion AN.

(Preparation of comparative emulsion MN)

Emulsion MN was prepared in the same manner as in the preparation of emulsion KN, except that the silver iodide fine grain emulsion AGI-9 was replaced in each occasion by the same weight of silver iodide fine grain emulsion AGI-11 of Example 1. The emulsion grains of the emulsion MN were composed of tabular grains having approximately the same grain size and configuration as those of the emulsion grains of the emulsion AN.

Processing was performed with the use of Negative Processor FP-350 manufactured by Fuji Photo Film Co., Ltd. in accordance with the following method (until the cumulative amount of replenisher became thrice the tank volume of mother liquor).

(Processing steps)

| Step | Time | Temp. ° C. | Replenishment rate |
|---|---|---|---|
| Color development | 2 min 45 sec | 38 | 45 mL |
| Bleaching | 1 min 00 sec | 38 | 20 mL whole of bleaching soln. overflow flows into bleach-fix tank |
| Bleach-fix | 3 min 15 sec | 38 | 30 mL |
| Water washing (1) | 40 sec | 35 | countercurrent piping from (2) to (1) |
| Water washing (2) | 1 min 00 sec | 35 | 30 mL |
| Stabilization | 40 sec | 38 | 20 mL |
| Drying | 1 min 15 sec | 55 | |

The replenishment rate is represented by a value per 1.1 m of a 35-mm wide sample (equivalent to one 24 Ex. film).

The composition of each processing solution was as follows.

| | Tank soln. (g) | Replenisher (g) |
|---|---|---|
| (Color developer) | | |
| Diethylenetriamine pentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]-2-methylaniline sulfate | 4.5 | 5.5 |
| Water | c q.s. ad 1.0 L | q.s. ad 1.0 L |
| pH | 10.05 | 10.10 |
| This pH was adjusted by the use of sulfuric acid and potassium hydroxide. | | |
| (Bleaching soln.) | | |
| Fe(III) ammonium ethylenediaminetetraacetate dihydrate | 120.0 | 120.0 |
| Disodium ethylenediaminetetraacetate | 10.0 | 10.0 |
| Ammonium bromide | 100.0 | 100.0 |
| Ammonium nitrate | 10.0 | 10.0 |
| Bleaching accelerator: $(CH_3)_2N—CH_2—CH_2–S–S–CH_2–CH_2–N(CH_3)_2.2HCl$ | 0.005 mol | 0.005 mol |
| Aq. ammonia (27%) | 15.0 mL | 15.0 mL |
| Water | q.s. ad 1.0 L | q.s. ad 1.0 L |
| pH | 6.3 | 6.3 |
| This pH was adjusted by the use of aqueous ammonia and nitric acid. | | |
| (Bleach-fix) | | |
| Fe(III) ammonium ethylenediaminetetraacetate dihydrate | 50.0 | — |
| Disodium ethylenediaminetetraacetate | 5.0 | 2.0 |
| Sodium sulfite | 12.0 | 20.0 |
| Aq. soln. of ammonium thiosulfate (700 g/L) | 240.0 mL | 400.0 mL |
| Aq. ammonia (27%) | 6.0 mL | — |
| Water | q.s. ad 1.0 L | q.s. ad 1.0 L |
| pH | 7.2 | 7.3 |
| This pH was adjusted by the use of aqueous ammonia and acetic acid. | | |

(Washing water): common to tank solution and replenisher.

Tap water was passed through a mixed-bed column filled with an H type strongly acidic cation exchange resin (Amberlite IR-120B: available from Rohm & Haas Co.) and an OH type anion exchange resin (Amberlite IR-400) to set the concentrations of calcium and magnesium ions to be 3 mg/L or less. Subsequently, 20 mg/L of sodium dichloroisocyanurate and 0.15 g/L of sodium sulfate were added. The pH of the solution ranged from 6.5 to 7.5.

(Stabilizer): common to tank solution and replenisher

| | (g) |
|---|---|
| Sodium p-toluenesulfinate | 0.03 |
| Polyoxyethylene p-monononylphenyl ether (average polymerization degree 10) | 0.2 |
| Disodium ethylenediaminetetraacetate | 0.05 |
| 1,2,4-triazole | 1.3 |
| 1,4-bis(1,2,4-triazol-1-ylmethyl) piperazine | 0.75 |
| Water | q.s. ad 1.0 L |
| pH | 8.5 |

The density of each processed sample was measured by the use of a green filter. The obtained results are given in Table 3 below. The sensitivity was expressed as a relative value of inverse of exposure required for reaching a density of fog density plus 0.2, and assuming that the sensitivity of emulsion AN was 100.

sensitivity. Further, the lightsensitive silver halide emulsion of the invention is substantially free from the sensitivity drop attributed to the storage of the silver iodide fine grain emulsion, both in a dissolved state, and in a refrigerated and set state. Although the performance similar to that of the silver iodide fine grain emulsion of the present invention is also realized by comparative silver iodide fine grain emulsion AGI-0, this AGI-0 has a low silver iodide content per liter of the emulsion, so that, when it is intended to use the same in practical emulsion production facilities, facilities for emulsion storage, conveyance, weighing and addition must be large. This is clearly disadvantageous as compared with the use of the silver iodide fine grain emulsion of the present invention in such practical emulsion production facilities.

Example 3

The silver iodobromide emulsion I of the 9th layer (high-speed green-sensitive emulsion layer) of the following silver halide multi-layer lightsensitive material was replaced

TABLE 3

| | AgI fine grain emulsion used to prepare sample | | | | Photographic sensitivity AgI fine grain emulsion used | | | |
|---|---|---|---|---|---|---|---|---|
| Sample (Remarks) | Emulsion No. | AgI content/L of emulsion (mol; 40° C.) | Electirc conductivity (μS/cm; 40° C.) | Gelatin used during grain formation *1 | Immediately after preparation | After storage at dissolved state; 50° C./6 H | After storage at dissolved state; 35° C./30 D | After storage at set state; 10° C./120 D |
| AN (comp.) | *AgI fine grain emulsion was not used. | | | | 100 | *NO AgI fine grain emulsion was used. | | |
| BN (comp.) | AGI-0 | 0.45 | 2150 | Gelatin-1 | 123 | 120 | 120 | 123 |
| CN (comp.) | AGI-1 | 0.83 | 2010 | Gelatin-1 | 117 | 85 | 80 | 90 |
| DN (comp.) | AGI-2 | 0.83 | 3080 | Gelatin-1 | 120 | 95 | 90 | 102 |
| EN (Inv.) | AGI-3 | 0.83 | 4950 | Gelatin-1 | 123 | 120 | 117 | 123 |
| FN (Inv.) | AGI-4 | 0.83 | 10130 | Gelatin-1 | 123 | 123 | 120 | 123 |
| GN (Inv.) | AGI-5 | 0.83 | 14050 | Gelatin-1 | 123 | 120 | 120 | 123 |
| HN (Comp.) | AGI-6 | 0.83 | 18910 | Gelatin-1 | 123 | 105 | 100 | 110 |
| IN (Inv.) | AGI-7 | 0.83 | 10150 | Gelatin-2 | 126 | 126 | 123 | 126 |
| JN (Inv.) | AGI-8 | 0.83 | 10100 | Gelatin-3 | 126 | 123 | 126 | 126 |
| KN (comp.) | AGI-9 | 0.62 | 2100 | Gelatin-1 | 119 | 92 | 87 | 97 |
| LN (Inv.) | AGI-10 | 0.62 | 10030 | Gelatin-1 | 123 | 123 | 121 | 123 |
| MN (comp.) | AGI-11 | 0.62 | 18100 | Gelatin-1 | 123 | 107 | 102 | 111 |

Note

*1) Gelatin-1: conventional alkali-treated ossein gelatin; Gelatin-2: gelatin with low methionine content; Gelatin-3: gelatin with chemically modified —$NH_2$ groups.

The following is apparent from the results of Table 3 and the results of Table 1 of Example 1. First, the photographic sensitivity is increased and the emulsion performance is enhanced by changing the method of forming silver iodide that contributes to the growth of emulsion grains of lightsensitive silver halide emulsion AN. Specifically, the above advantages were attained by changing the method of forming the silver iodide from the addition of an aqueous solution of $AgNO_3$ and an aqueous solution of halide according to the double jet method, to the addition of the silver iodide fine grain emulsion according to the present invention. Secondly, the degree of aggregation of silver iodide fine grains in the silver iodide fine grain emulsion added during the growth of emulsion grains, influences the photographic sensitivity of the lightsensitive silver halide emulsion. The lower the degree of aggregation of silver iodide fine grains, the higher the photographic sensitivity of the lightsensitive silver halide emulsion, and the greater the degree of aggregation, the lower the photographic sensitivity.

The lightsensitive silver halide emulsion obtained by conducting the grain growth of silver iodide-containing portion by the use of the silver iodide fine grain emulsion of the present invention, favorably exhibits high photographic in the same silver quantity by each of the emulsions prepared in Example 2. Comparing the performance of the samples thus obtained, the same effects as those of the present invention demonstrated in Example 2 were recognized. Namely, the silver halide multi-layer lightsensitive material of the invention, in which the lightsensitive silver halide emulsion containing silver halide grains obtained through the step of growing silver iodide portion thereof by adding the silver iodide fine grain emulsion of the present invention was used in the high-speed green-sensitive emulsion layer, favorably exhibited high sensitivity in the green-sensitive emulsion layer. The silver halide multi-layer lightsensitive material of the invention also had only slight photographic sensitivity fluctuations attributed to storage conditions of the silver iodide fine grain emulsion, both in the storage in a dissolved state, and in a refrigerated and set state.

1) Support:

The support employed in this Example was prepared by the following method.

100 parts by weight of polyethylene-2,6-naphthalate (hereinafter referred to as "PEN") and 2 parts by weight of Tinuvin P.326 (produced by Ciba-Geigy) as an ultraviolet absorber were dried, melted at 300° C., extruded through a T die, longitudinally oriented at 140° C. to a 3.3-fold length, laterally oriented at 130° C. to a 3.3-fold width and thermally set at 250° C. for 6 sec. Thus, a PEN film having a thickness of 90 μm was obtained. Appropriate amounts of blue dye, magenta dye and yellow dye (I-1, I-4, I-6, I-24, I-26, I-27 and II-5 described in Kokai Giho No. 94-6023) were mixed in this PEN film. Further, this PEN film was wound round a stainless steel core with a diameter of 20 cm, and a 110° C./48 hr heat history was imparted thereto. Thus, a support with a low tendency to curl was obtained.

2) Coating of subbing layer:

Both sides of the above support were treated by corona discharge, UV discharge and glow discharge, and a subbing liquid consisting of 0.1 g/m$^2$ of gelatin, 0.01 g/m$^2$ of sodium α-sulfo-di-2-ethylhexyl succinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of polyamide/epichlorohydrin polycondensate was applied thereto (10 mL/m$^2$ by the use of a bar coater). A subbing layer was provided on a side exposed to high temperature at the time of orientation. Drying was conducted at 115° C. for 6 min (all of the rollers and conveyor of drying zone were heated at 115° C.).

3) Coating of back layer:

After the subbing, an antistatic layer, a magnetic recording layer and a slide layer of the following respective compositions as back layers were applied by coating to one side of the support.

3-1) Coating of antistatic layer by coating:

Coating was made of 0.2 g/m$^2$ of dispersion of fine grain powder with a resistivity of 5 Ω·cm (secondary aggregate grain diameter: approximately 0.08 μm) of tin oxide/antimony oxide composite having an average particle size of 0.005 μm, 0.05 g/m$^2$ of gelatin, 0.02 g/m$^2$ of $(CH_2{=}CHSO_2CH_2CH_2NHCO)_2CH_2$, 0.005 g/m$^2$ of poly (polymerization degree 10)oxyethylene-p-nonylphenol and resorcinol.

3-2) Coating of magnetic recording layer:

A magnetic recording layer having a thickness of 1.2 μm was obtained by applying by means of a bar coater 0.06 g/m$^2$ of cobalt/γ-iron oxide (specific surface area: 43 m$^2$/g, major axis: 0.14 μm, minor axis: 0.03 μm, saturation magnetization: 89 emu/g, $Fe^{2+}/Fe^{3+}$=6/94, surface being treated with aluminum oxide/silicon oxide in an amount of 2% by weight based on iron oxide) coated with 3-poly(polymerization degree: 15)oxyethylene/propyloxytrimethoxysilane (15% by weight), 1.2 g/m$^2$ of diacetylcellulose (iron oxide was dispersed by the use of an open kneader and a sand mill) and 0.3 g/m$^2$ of $C_2H_5C(CH_2OCONH{-}C_6H_3(CH_3)NCO)_3$ as a hardener together with acetone, methyl ethyl ketone and cyclohexanone as solvents. As a matting agent, silica particles (0.3 μm) and abrasive aluminum oxide (0.15 μm) coated with 3-poly(polymerization degree 15)oxyethylene/propyloxytrimethoxysilane (15% by weight) were each added in an amount of 10 mg/m$^2$. Drying was conducted at 115° C. for 6 min (all of the rollers and conveyor of drying zone were heated at 115° C.). With respect to the obtained magnetic recording layer, the DB color density increment with X-rite (blue filter), saturation magnetization moment, coercive force and rectangular ratio were approximately 0.1, 4.2 emu/g, 7.3×10$^4$ A/m and 65%, respectively.

3-3) Preparation of slide layer:

Coating was made of a mixture of diacetylcellulose (25 mg/m$^2$) and $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). This mixture was prepared by melting in xylene/propylene monomethyl ether (1/1) at 105° C. and pouring and dispersing in propylene monomethyl ether (10-fold amount) at ordinary temperature and formed into a dispersion (average particle size: 0.01 μm) in acetone before addition. As a matting agent, silica particles (0.3 μm) and abrasive aluminum oxide (0.15 μm) coated with 3-poly (polymerization degree 15)oxyethylene/propyloxytrimethoxysilane (15% by weight) were each added in an amount of 15 mg/m$^2$. Drying was conducted at 115° C. for 6 min (all of the rollers and conveyor of drying zone were heated at 115° C.). With respect to the obtained slide layer, the kinematic friction coefficient (stainless steel hard ball with a diameter of 5 mm, load: 100 g, speed: 6 cm/min), static friction coefficient (clip method) and kinematic friction coefficient between emulsion face and slide layer as described later were 0.06, 0.07 and 0.12, respectively, ensuring excellent performance.

A sample of multi-layer color lightsensitive material was prepared by applying a multiplicity of layers with the following respective compositions onto the obtained film support.

(Composition of lightsensitive layer)

Main materials used in each layer are classified as follows:

ExC: cyan coupler, UV: ultraviolet absorber,

ExM: magenta coupler, HBS: high b.p. org. solvent,

ExY: yellow coupler, H: gelatin coupler,

ExS: spectral sensitizing dye

The numeric value given beside the description of each component is for the coating amount expressed in the unit of g/m$^2$. With respect to the silver halide, the coating amount is in terms of silver quantity, provided that, regarding the spectral sensitizing dye, the coating amount is expressed in the unit of mol per mol of silver halide present in the same layer.

| 1st layer (antihalation layer) | |
|---|---|
| Black colloidal silver | silver 0.09 |
| Gelatin | 1.60 |
| ExM-1 | 0.12 |
| ExF-1 | 2.0 × 10$^{-3}$ |
| Solid disperse dye ExF-2 | 0.030 |
| Solid disperse dye ExF-3 | 0.040 |
| HBS-1 | 0.15 |
| HBS-2 | 0.02 |
| **2nd layer (Interlayer)** | |
| Silver iodobromide emulsion M | silver 0.065 |
| ExC-2 | 0.04 |
| Polyethyl acrylate latex | 0.20 |
| Gelatin | 1.04 |
| **3rd layer (Low-speed red-sensitive emulsion layer)** | |
| Silver iodobromide emulsion A | silver 0.25 |
| Silver iodobromide emulsion B | silver 0.25 |
| ExS-1 | 6.9 × 10$^{-5}$ |
| ExS-2 | 1.8 × 10$^{-5}$ |
| ExS-3 | 3.1 × 10$^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |

-continued

| 4th layer (Medium-speed red-sensitive emulsion layer) | |
|---|---|
| Silver iodobromide emulsion C | silver 0.68 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |

| 5th layer (High-speed red-sensitive emulsion layer) | |
|---|---|
| Silver iodobromide emulsion D | silver 1.44 |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |

| 6th layer (Interlayer) | |
|---|---|
| Cpd-1 | 0.090 |
| Solid disperse dye ExF-4 | 0.030 |
| HBS-1 | 0.050 |
| Polyethyl acrylate latex | 0.15 |
| Gelatin | 1.10 |

| 7th layer (Low-speed green-sensitive emulsion layer) | |
|---|---|
| Silver iodobromide emulsion E | silver 0.15 |
| Silver iodobromide emulsion F | silver 0.10 |
| Silver iodobromide emulsion G | silver 0.10 |
| ExS-4 | $3.0 \times 10^{-4}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |

| 8th layer (Medium-speed green-sensitive emulsion layer) | |
|---|---|
| Silver iodobromide emulsion H | silver 0.83 |
| ExS-4 | $3.2 \times 10^{-4}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.O0 \times 10^{-3}$ |
| Gelatin | 0.80 |

| 9th layer (High-speed green-sensitive emulsion layer) | |
|---|---|
| Silver iodobromide emulsion I | silver 1.22 |
| ExS-4 | $8.8 \times 10^{-5}$ |
| ExS-5 | $4.6 \times 10^{-5}$ |
| ExS-6 | $3.4 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |

-continued

| | |
|---|---|
| Polyethyl acrylate latex | 0.15 |
| Gelatin | 1.33 |

| 10th layer (Yellow filter layer) | |
|---|---|
| Yellow colloidal silver | silver 0.015 |
| Cpd-1 | 0.16 |
| Solid disperse dye ExF-5 | 0.060 |
| Solid disperse dye ExF-6 | 0.060 |
| Oil-soluble dye ExF-7 | 0.010 |
| HBS-1 | 0.60 |
| Gelatin | 0.60 |

| 11th layer (Low-speed blue-sensitive emulsion layer) | |
|---|---|
| Silver iodobromide emulsion J | silver 0.08 |
| Silver iodobromide emulsion K | silver 0.08 |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |

| 12th layer (High-speed blue-sensitive emulsion layer) | |
|---|---|
| Silver iodobromide emulsion L | silver 1.05 |
| ExS-7 | $4.3 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |

| 13th layer (1st protective layer) | |
|---|---|
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |

| 14th layer (2nd protective layer) | |
|---|---|
| Silver iodobromide emulsion M | silver 0.10 |
| H-1 | 0.40 |
| B-1 (diameter 1.7 $\mu$m) | $5.0 \times 10^{-2}$ |
| B-2 (diameter 1.7 $\mu$m) | 0.15 |
| B-3 | 0.05 |
| S-1 | 0.20 |
| Gelatin | 0.70 |

In addition to the above components, W-1 to W-3, B-4 to B-6, F-1 to F-17, iron salt, lead salt, gold salt, platinum salt, palladium salt, iridium salt and rhodium salt were appropriately added to the individual layers in order to improve the storage stability, processability, resistance to pressure, antiseptic and mildewproofing properties, antistatic properties and coating properties.

The average AgI content and grain size of each of emulsions A to H and J to M used in sample preparation are given in Table 4 below.

TABLE 4

| | Average AgI content (%) | Variation coefficient of inter grain AgI content (%) | Average diameter; equivalent sphere diameter (μm) | Variation coefficient of grain diameter (%) | Equivalent diameter of projected area (μm) | Diameter/thickness ratio |
|---|---|---|---|---|---|---|
| Emulsion A | 1.7 | 10 | 0.46 | 15 | 0.56 | 5.5 |
| Emulsion B | 3.3 | 7 | 0.57 | 20 | 0.78 | 4.0 |
| Emulsion C | 8.9 | 18 | 0.66 | 17 | 0.87 | 5.8 |
| Emulsion D | 8.7 | 18 | 0.84 | 18 | 1.03 | 3.7 |
| Emulsion E | 1.7 | 10 | 0.46 | 15 | 0.56 | 5.5 |
| Emulsion F | 3.3 | 15 | 0.57 | 13 | 0.78 | 4.0 |
| Emulsion G | 8.8 | 13 | 0.61 | 17 | 0.77 | 4.4 |
| Emulsion H | 8.8 | 25 | 0.61 | 23 | 0.77 | 4.4 |
| Emulsion J | 1.7 | 10 | 0.46 | 15 | 0.50 | 4.2 |
| Emulsion K | 8.8 | 15 | 0.64 | 19 | 0.85 | 5.2 |
| Emulsion L | 14.2 | 18 | 1.28 | 19 | 1.46 | 3.5 |
| Emulsion M | 1.0 | — | 0.07 | 15 | — | 1 |

In Table 4, (1) Emulsions A to H and J to L were subjected to a reduction sensitization using thiourea dioxide and thiosulfonic acid during grain preparation in accordance with Examples of JP-A-2-191938;

(2) With respect to emulsions A to H and J to L, the lightsensitive layers were subjected to gold sensitization, sulfur sensitization and selenium sensitization in the presence of described spectral sensitizing dye and sodium thiocyanate in accordance with Examples of JP-A-3-237450;

(3) In the preparation of tabular grains, low molecular weight gelatin was used in accordance with Examples of JP-A-1-158426;

(4) Dislocation lines as described in JP-A-3-237450 were observed in tabular grains by means of a high voltage electron microscope; and (5) Emulsion L was composed of double-structure grains having an internal high-iodide core described in JP-A-60-143331.

Preparation of dispersions of organic solid disperse dyes:

The dye, ExF-2, was dispersed by the following method. Specifically, 21.7 mL of water, 3 mL of a 5% aqueous solution of sodium p-octylphenoxyethoxyethanesulfonate, and 0.5g of a 5% aqueous solution of p-octylphenoxypolyoxyethylene ether (polymerization degree: 10) were placed in a 700-mL pot mill, and 5.0 g of the dye ExF-2 and 500 mL of zirconium oxide beads (diameter 1 mm) were added to the mill. The contents were dispersed for 2 hr. This dispersion was conducted by using a BO type oscillating ball mill manufactured by Chuo Koki K.K. Thereafter, the contents were removed from the mill and 8 g of a 12.5% aqueous solution of gelatin was added thereto. The beads were removed from the resultant material by filtration, obtaining a gelatin dispersion of the dye. The average grain size of the fine dye grains was 0.44 μm.

Following the same procedure as above, solid dispersions of ExF-3, ExF-4 and ExF-6 were obtained. The average grain sizes of these fine dye grains were 0.24, 0.45, and 0.52 μm, respectively. ExF-5 was dispersed by the microprecipitation dispersion method described in Example 1 of EP 549,489A. The average grain size thereof was found to be 0.06 μm.

The following are chemical structures and the like of the compounds used in Example.

ExC-1

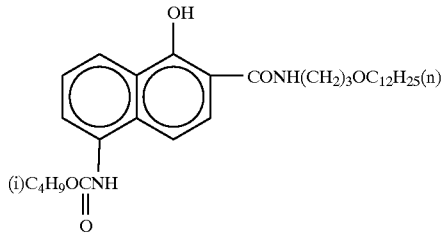

ExC-2

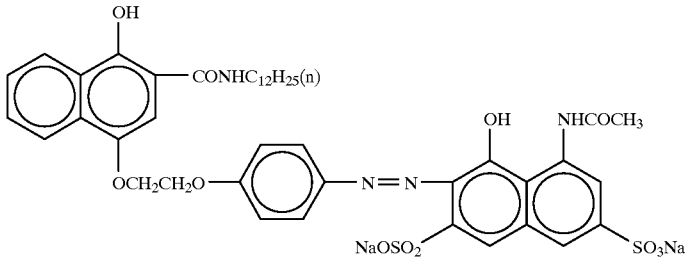

-continued
ExC-3
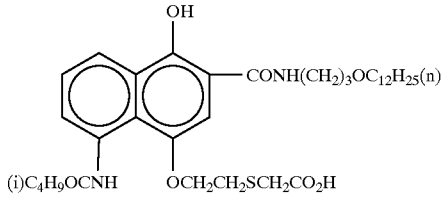
ExC-4
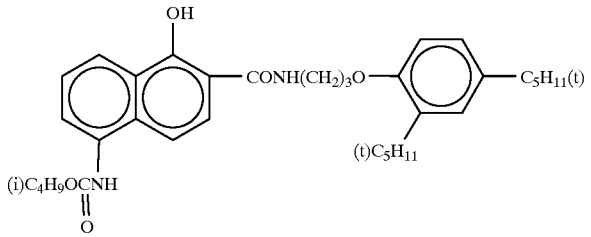
ExC-5
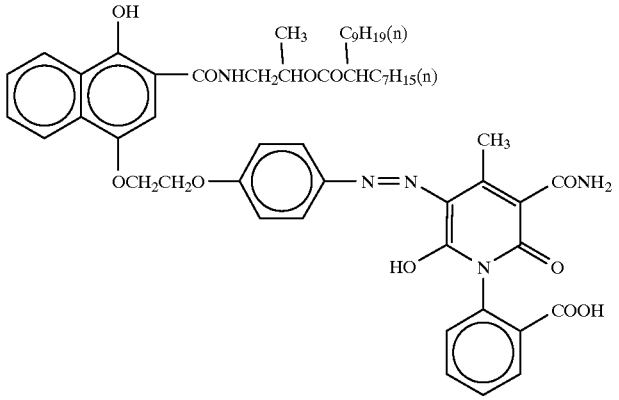
ExC-6
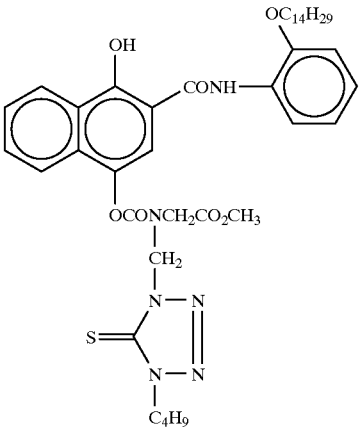
ExC-7
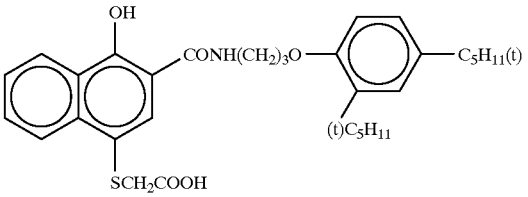

-continued
ExC-8
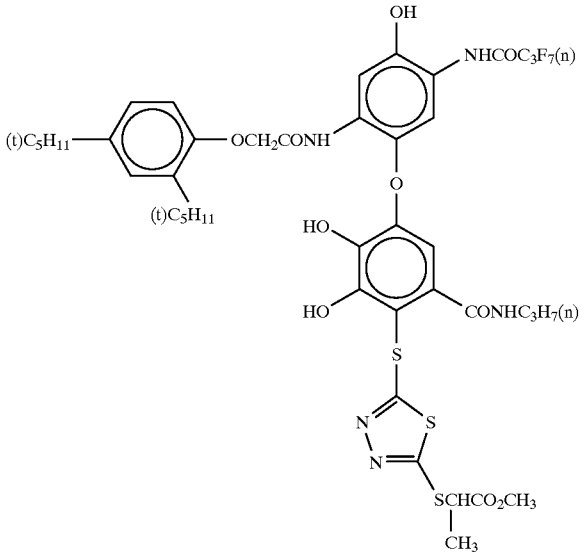
ExM-1
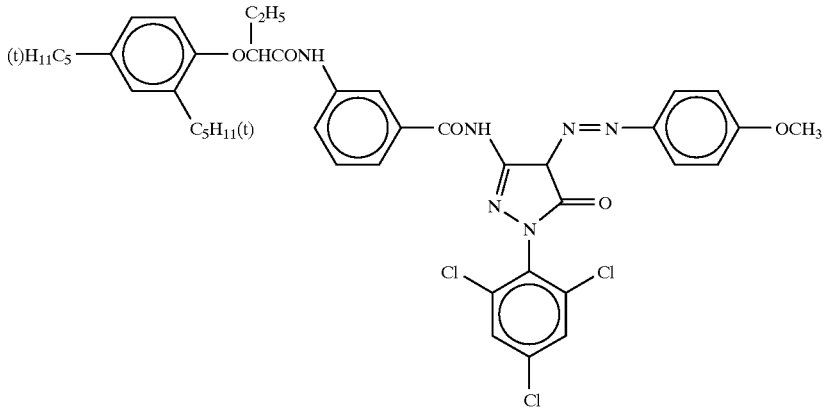
ExM-2
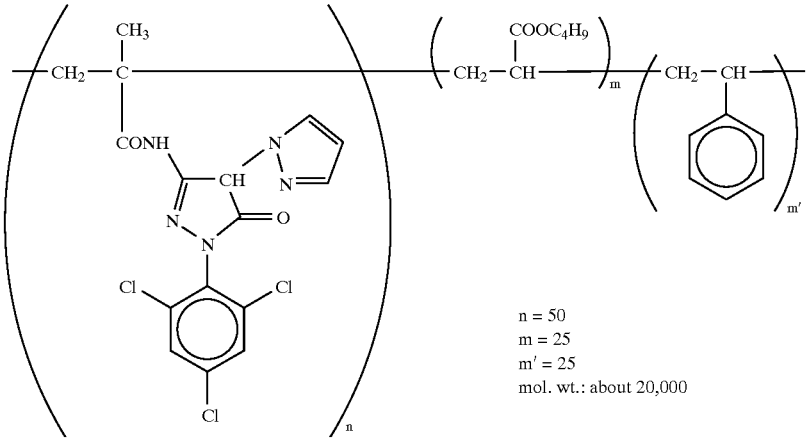

-continued
ExM-3
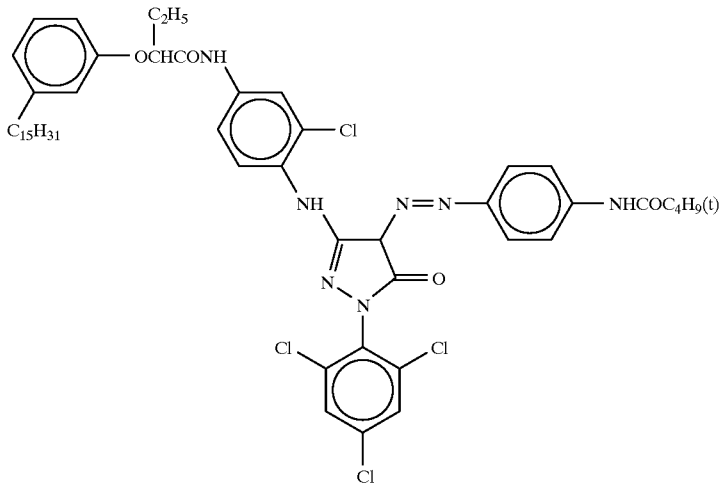
ExM-4
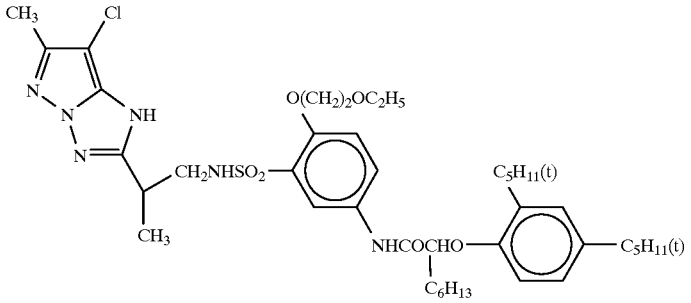
ExM-5
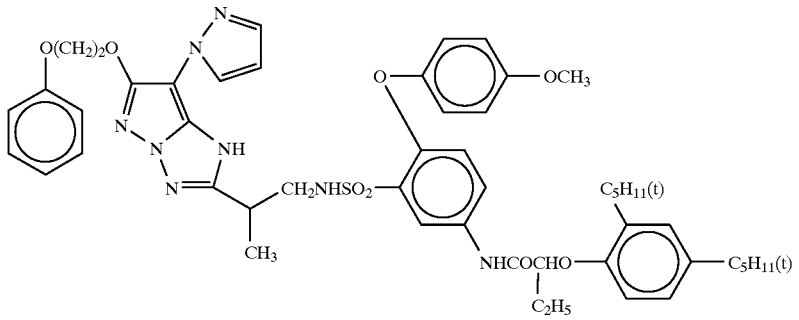
ExY-1
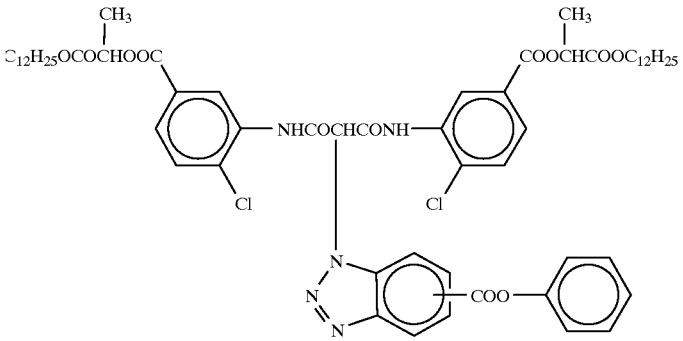

-continued
ExY-2
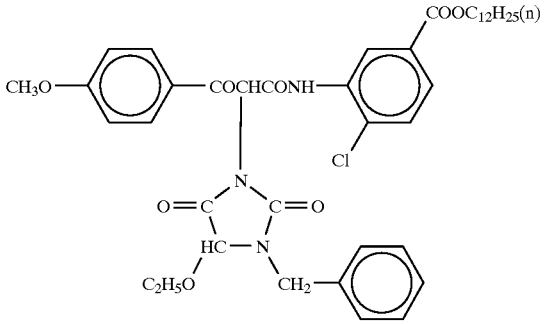
ExY-3
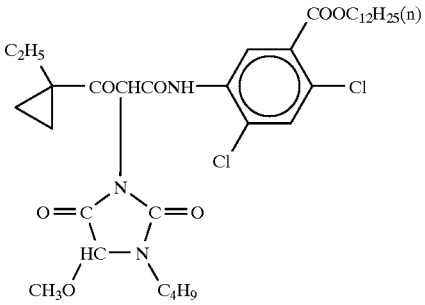
ExY-4
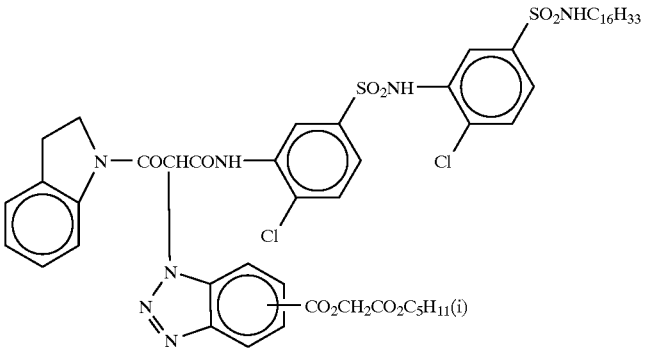
ExY-5
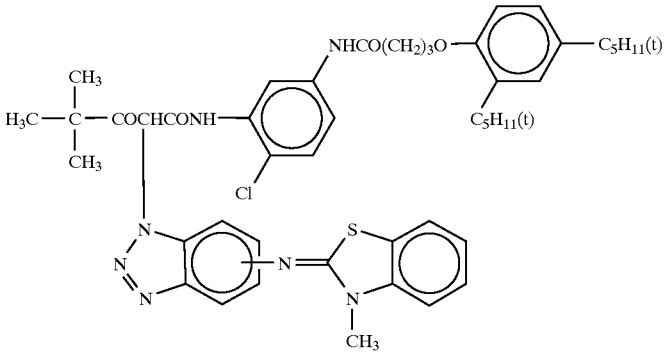

-continued
ExF-1
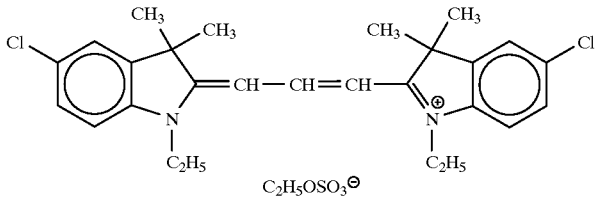
ExF-2
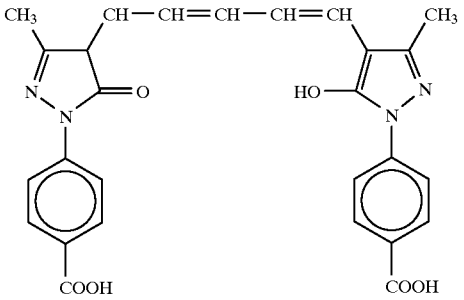
ExF-3
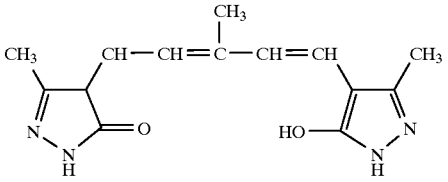
ExF-4
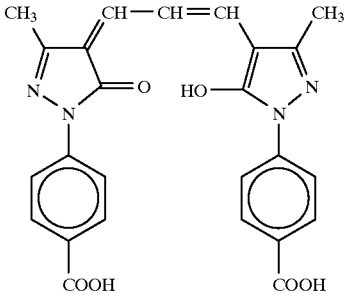
ExF-5
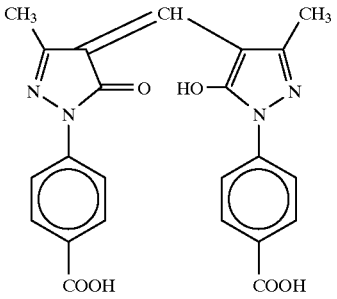
ExF-6
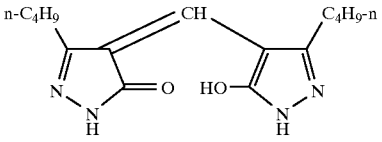

-continued
ExF-7
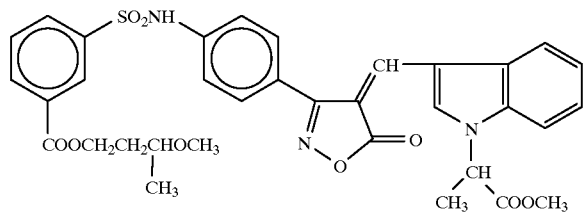
Cpd-1
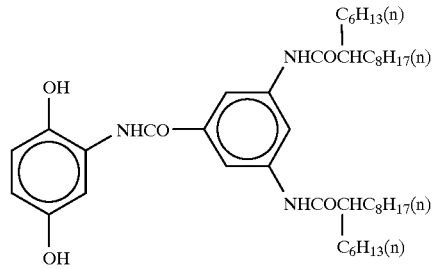
Cpd-2
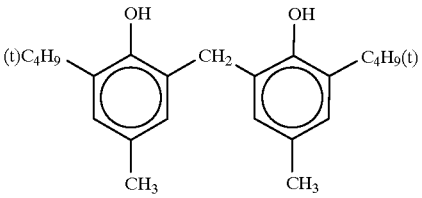
Cpd-3
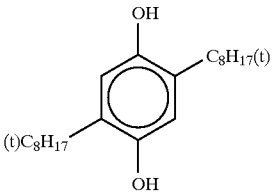
UV-1
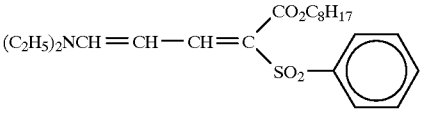
UV-2
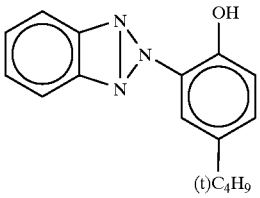
UV-3
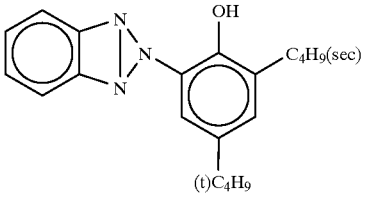

HBS-1 Tricresyl phosphate
HBS-2 Di-n-butyl phthalate
HBS-3
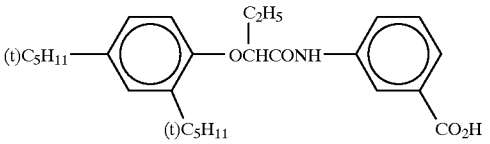
HBS-4 Tri (2-ethylhexly) phosphate
ExS-1
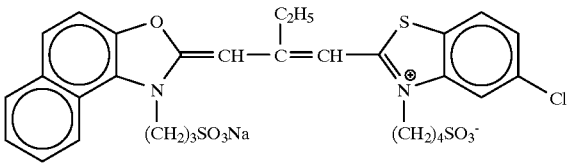
ExS-2
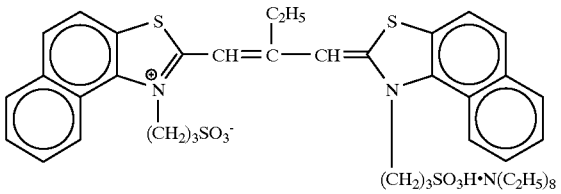
ExS-3
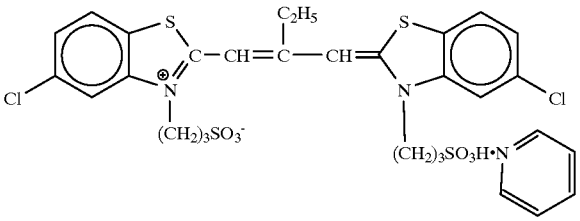
ExS-4
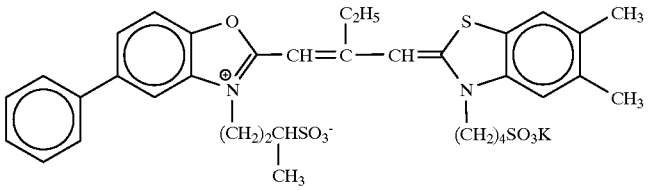
ExS-5
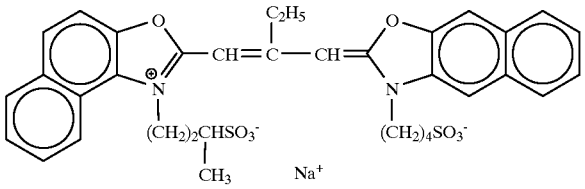
ExS-6
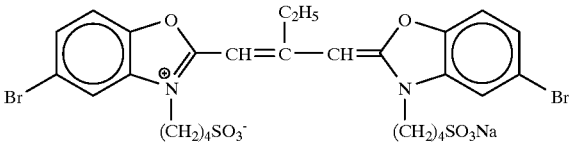

-continued
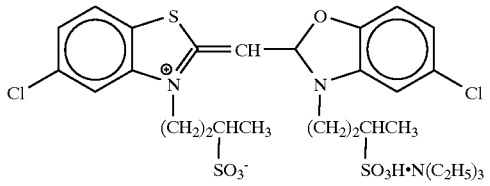
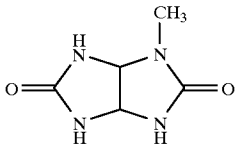
H-1
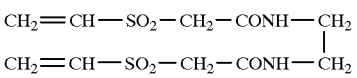
B-1
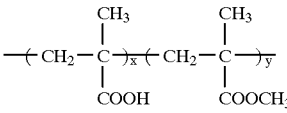
x/y = 10/90 (weight ratio)
Av. mol. wt.: about 35,000
B-2
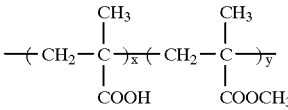
x/y = 40/60 (weight ratio)
Av. mol. wt.: about 20,000
B-3
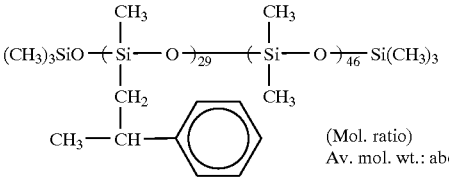
(Mol. ratio)
Av. mol. wt.: about 8,000
B-4
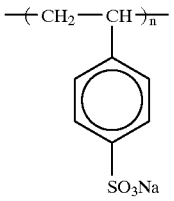
Av. mol. wt.: about 750,000
B-5
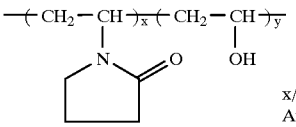
x/y = 40/60 (weight ratio)
Av. mol. wt.: about 17,000
ExS-7
S-1
-continued
B-6
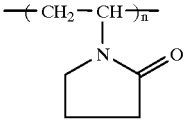
Av. mol. wt.: about 10,000
W-1
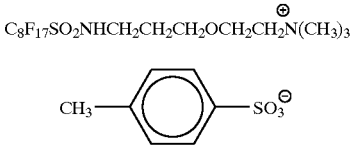
W-2
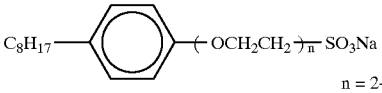
n = 2–4
W-3
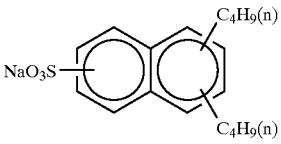
F-1
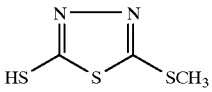
F-2
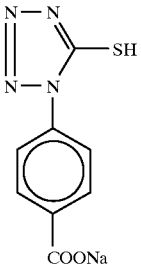

-continued

F-3

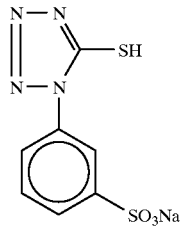

F-4

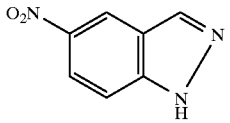

F-5

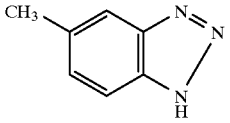

F-6

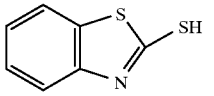

F-7

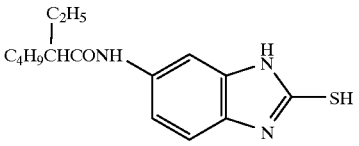

F-8

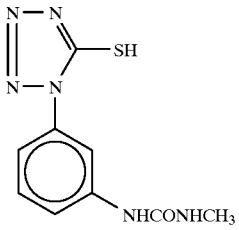

F-9

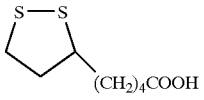

F-10

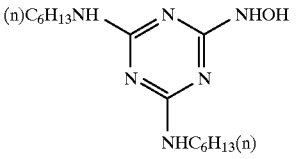

F-11

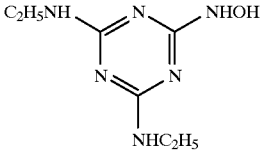

-continued

F-12

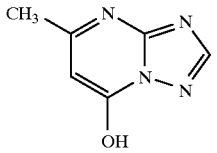

F-13

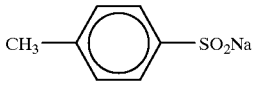

F-14

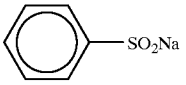

F-15

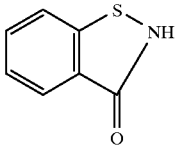

F-16

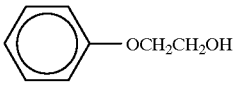

F-17

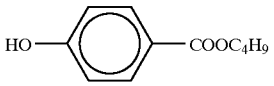

The thus obtained sample was subjected to exposure for sensitometry for 1/100 sec through a continuous wedge at a color temperature of 4800° K. and thereafter to the following color development.

The processing steps will be described below.

| Step | Time | Temp. ° C. | Replenishment rate | Tanc vol. (L) |
|---|---|---|---|---|
| Color development | 3 min 15 sec | 38 | 33 mL | 20 |
| Bleaching | 6 min 30 sec | 38 | 25 mL | 40 |
| Water washing | 2 min 10 sec | 24 | 1,200 mL | 20 |
| Fixing | 4 min 20 sec | 38 | 25 mL | 30 |
| Water washing (1) | 1 min 05 sec | 24 | countercurrent piping from (2) to (1) | 10 |
| Water washing (2) | 1 min 00 sec | 24 | 1,200 mL | 10 |
| Water washing (3) | 1 min 05 sec | 38 | 25 mL | 10 |
| Drying | 4 min 20 sec | 55 | | |

The replenishment rate is represented by a value per m of a 35-mm wide sample.

The composition of each processing solution was as follows.

| (Color developer) | Mother liq. (g) | Replenisher (g) |
|---|---|---|
| Diethylenetriamine pentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]-2-methylaniline sulfate | 4.5 | 5.5 |
| Water | q.s. ad 1.0 L | q.s. ad 1.0 L |
| pH | 10.05 | 10.10 |

| (Bleaching soln.) | Mother liq. (g) | Replenisher (g) |
|---|---|---|
| Fe(III) sodium ethylenediaminetetraacetate trihydrate | 100.0 | 120.0 |
| Disodium ethylenediaminetetraacetate | 10.0 | 11.0 |
| Ammonium bromide | 140.0 | 160.0 |
| Ammonium nitrate | 30.0 | 35.0 |
| Aq. ammonia (27%) | 6.5 mL | 4.0 mL |
| Water | q.s. ad 1.0 L | q.s. ad 1.0 L |
| pH | 6.0 | 5.7 |

| (Fixing soln.) | Mother liq. (g) | Replenisher (g) |
|---|---|---|
| Sodium ethylenediaminetetraacetate | 0.5 | 0.7 |
| Sodium sulfite | 7.0 | 8.0 |
| Sodium bisulfite | 5.0 | 5.5 |
| aq. soln. of ammonium thiosulfate (70%) | 170.0 mL | 200.0 mL |
| Water | q.s. ad 1.0 L | q.s. ad 1.0 L |
| pH | 6.7 | 6.6 |

| (Stabilizer): | Mother liq. (g) | Replenisher (g) |
|---|---|---|
| Formalin (37%) | 2.0 mL | 3.0 mL |
| Polyoxyethylene p-monononylphenyl ether (average polymerization degree 10) | 0.3 | 0.45 |
| Disodium ethylenediaminetetraacetate | 0.05 | 0.08 |
| Water | q.s. ad 1.0 L | q.s. ad 1.0 L |
| pH | 5.8–8.0 | 5.8–8.0 |

Example 4

Film with a size 220 was prepared in the same manner as in the preparation of the sample of Example 3, except that the thickness of support PEN was changed to 98 μm and that the coated film sample was processed into size 220 in accordance with IS0732:1991(E) and was wound round spool produced also in accordance with IS0732:1991(E). The performances were compared and the same effects as those of the present invention demonstrated in Example 3 were recognized.

Example 5

This Example demonstrates that, in the preparation of a lightsensitive silver halide emulsion through the step of forming an extremely thin silver iodide layer in the vicinity of grain surface just before chemical sensitization, it is advantageous to form the above extremely thin silver iodide layer by adding the silver iodide fine grain emulsion of the present invention just before chemical sensitization.

(Preparation of comparative emulsion AX)

1000 mL of an aqueous solution containing 6.2 g of low molecular weight gelatin (average molecular weight: 15,000) and 6.9 g of KBr was maintained at 49° C. and agitated [preparation of 1st solution]. An aqueous solution of $AgNO_3$ (4.0 g) and an aqueous solution of KBr (5.9 g) were added according to the double jet method over a period of 37 sec. Subsequently, an aqueous solution containing 18.6 g of gelatin-1 specified in Example 1 was added, and the mixture was heated to 64° C. while adding an aqueous solution of $AgNO_3$ (9.8 g) over a period of 22 min. Thereafter, 4.2 mL of a 25% aqueous ammonia was added, and, 10 min later, an aqueous solution containing 3.9 g of acetic acid was added. Next, an aqueous solution of $AgNO_3$ (151.0 g) and a 20% by weight aqueous solution of KBr were added, while increasing the flow rate, according to a double jet method over a period of 35 min. During this period, the silver potential against saturation calomel electrode was maintained at −44 mV. When 95% of the above $AgNO_3$ (151.0 g) was added, an aqueous solution of 0.05 g of $K_3IrCl_6$ was added. After the completion of the addition, 45 mL of a 2N aqueous solution of potassium thiocyanate was added. Thereafter, desalting was conducted by a usual flocculation method. Then, water, NaOH, KBr, $AgNO_3$ and gelatin-1 specified in Example 1 were added under agitation and the pH and pAg at 40° C. were adjusted to 6.0 and 7.8, respectively.

The temperature of the emulsion prepared by the above process was adjusted to 56° C. Thereafter, an aqueous solution of KI (0.16 g) was added, and 4-hydroxy-6-methyl-1,3,3a,7-tetrazaindene, the following spectral sensitizing dye IV, the following selenium compound, sodium thiosulfate, potassium thiocyanate and chloroauric acid were added, thereby effecting optimum chemical sensitization.

Sensitizing Dye-IV

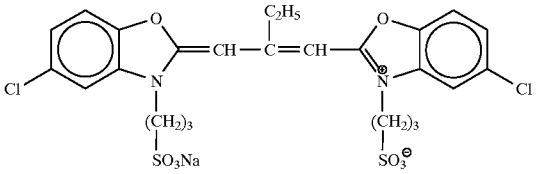

Selenium compound-II

An equimolar mixture of

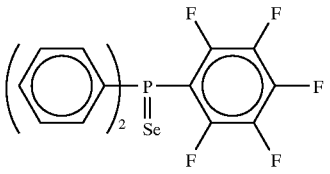

and

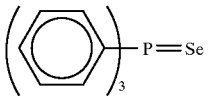

The thus obtained emulsion was designated emulsion AX. The emulsion AX was composed of tabular grains having an average equivalent circular diameter of 0.83 μm, a variation coefficient of equivalent circular diameter of 15%, an average thickness of 0.14 μm and an average aspect ratio of 6.2. The grains having an aspect ratio of at least 3 occupied 93% of the total projected area.

(Preparation of comparative emulsion BX)

Emulsion BX was prepared by the same process as in the preparation of the emulsion AX, except that 2.1 mL of silver iodide fine grain emulsion AGI-0 of Example 1 in a dissolved state at 40° C. was added in place of the aqueous solution of KI (0.16 g) that was added immediately before the initiation of the chemical sensitizations. The emulsion grains of the emulsion BX were composed of tabular grains having approximately the same grain size and configuration as those of the emulsion grains of the emulsion AX.

In this Example, four sets of the above emulsion BX and four sets each of the following emulsions CX to JX were prepared with the use of silver iodide fine grains held under the following four conditions, respectively:

(i) immediately after preparation of silver iodide fine grain emulsion, (ii) stored in a 50° C., dissolved state for 6 hr, (iii) stored in a 35° C., dissolved state for 30 days, and (iv) stored in a 10° C., set state for 120 days.

(Preparation of comparative emulsions CX and DX)

Emulsion CX was prepared by the same process as in the preparation of the emulsion AX, except that 1.2 mL of silver iodide fine grain emulsion AGI-1 of Example 1 in a dissolved state at 40° C. was added in place of the aqueous solution of KI (0.16 g) that was added immediately before the initiation of the chemical sensitizations. The emulsion grains of the emulsion CX were composed of tabular grains having approximately the same grain size and configuration as those of the emulsion grains of the emulsion AX.

Emulsion DX was prepared in the same manner as in the preparation of the emulsion CX, except that the silver iodide fine grain emulsion AGI-1 was replaced in each occasion by the same weight of silver iodide fine grain emulsion AGI-2 of Example 1. The emulsion grains of the emulsion DX were composed of tabular grains having approximately the same grain size and configuration as those of the emulsion grains of the emulsion AX.

(Preparation of emulsions EX to GX according to the present invention)

Emulsion EX was prepared in the same manner as in the preparation of the emulsion CX, except that the silver iodide fine grain emulsion AGI-1 was replaced in each occasion by the same weight of silver iodide fine grain emulsion AGI-3 of Example 1.

Emulsion FX was prepared in the same manner as in the preparation of the emulsion CX, except that the silver iodide fine grain emulsion AGI-1 was replaced in each occasion by the same weight of silver iodide fine grain emulsion AGI-4 of Example 1.

Emulsion GX was prepared in the same manner as in the preparation of the emulsion CX, except that the silver iodide fine grain emulsion AGI-1 was replaced in each occasion by the same weight of silver iodide fine grain emulsion AGI-5 of Example 1.

The emulsion grains of the emulsions EX to GX were composed of tabular grains having approximately the same grain size and configuration as those of the emulsion grains of the emulsion AX.

(Preparation of comparative emulsion HX)

Emulsion HX was prepared in the same manner as in the preparation of the emulsion CX, except that the silver iodide fine grain emulsion AGI-1 was replaced in each occasion by the same weight of silver iodide fine grain emulsion AGI-6 of Example 1. The emulsion grains of the emulsion HX were composed of tabular grains having approximately the same grain size and configuration as those of the emulsion grains of the emulsion AX.

(Preparation of emulsions IX and JX according to the present invention)

Emulsion IX was prepared in the same manner as in the preparation of the emulsion CX, except that the silver iodide fine grain emulsion AGI-1 was replaced in each occasion by the same weight of silver iodide fine grain emulsion AGI-7 of Example 1.

Emulsion JX was prepared in the same manner as in the preparation of the emulsion CX, except that the silver iodide fine grain emulsion AGI-1 was replaced in each occasion by the same weight of silver iodide fine grain emulsion AGI-8 of Example 1.

The emulsion grains of the emulsions IX and JX were composed of tabular grains having approximately the same grain size and configuration as those of the emulsion grains of the emulsion AX.

(Preparation of comparative emulsion KX)

Emulsion KX was prepared by the same process as in the preparation of the emulsion AX, except that 1.6 mL of silver iodide fine grain emulsion AGI-9 of Example 1 in a dissolved state at 40° C. was added in place of the aqueous solution of KI (0.16 g) that was added immediately before the initiation of the chemical sensitizations. The emulsion grains of the emulsion KX were composed of tabular grains having approximately the same grain size and configuration as those of the emulsion grains of the emulsion AX.

(Preparation of emulsion LX according to the present invention)

Emulsion LX was prepared in the same manner as in the preparation of the emulsion KX, except that the silver iodide fine grain emulsion AGI-9 was replaced in each occasion by the same weight of silver iodide fine grain emulsion AGI-10 of Example 1. The emulsion grains of the emulsion LX were composed of tabular grains having approximately the same grain size and configuration as those of the emulsion grains of the emulsion AX.

(Preparation of comparative emulsion MX)

Emulsion MX was prepared in the same manner as in the preparation of the emulsion KX, except that the silver iodide fine grain emulsion AGI-9 was replaced in each occasion by the same weight of silver iodide fine grain emulsion AGI-11 of Example 1. The emulsion grains of the emulsion MX were composed of tabular grains having approximately the same grain size and configuration as those of the emulsion grains of the emulsion AX.

(Preparation of emulsion surface coating fluid)

[Emulsion layer coating fluid]

The above emulsions AX to JX were each loaded with the following additives per mol of silver halide, thereby preparing emulsion layer coating fluids.

| | |
|---|---|
| 2,6-bis(hydroxyamino)-4-diethylamino 1,3,5-triazine | 72.0 mg |
| Dextran (av. mol. wt.: 39 thousand) | 3.9 g |
| Potassium polystyrenesulfonate (av. mol. wt.: 600 thousand) | 0.7 g |
| Additive-I | 7.0 mg |
| Sodium hydroquinonemonosulfonate | 8.2 g |
| Snotex C (Nissan Chemical Ind., Ltd.) | 10.5 g |
| Ethyl acrylate/methacrylic acid (97/3) copolymer latex | 9.7 g |
| Gelatin | regulated so that the coating amount per emulsion layer became 2.6 g/m$^2$ |
| Film hardener (1,2-bis(vinylsulfonylacetamido)ethane) | regulated so that the swelling ratio became 230% |

[Preparation of surface protective layer coating fluid]

Coating fluid b-1 was prepared by using the following components in the following amounts.

| | |
|---|---|
| Gelatin | 650 mg |
| Poly(sodium acrylate) (av. MW: 400 | 18 |

-continued

| | |
|---|---|
| thousand) | |
| Butyl acrylate/methacrylic acid (4/6) copolymer latex (av. MW: 120 thousand) | 120 |
| Coating aid-I | 18 |
| Coating aid-II | 45 |
| Coating aid-IV | 0.9 |
| Coating aid-V | 0.61 |
| Coating aid-VII | 26 |
| Additive- II | 1.3 |
| Polymethyl methacrylate (av. grain size: 2.5 $\mu$m) | 87 |
| Proxel | 0.5 |
| Poly(potassium styrenesulfonate) | 0.9 |

(av. MW: 600 thousand)

(pH was adjusted to 7.4 with NaOH)

Additive-I

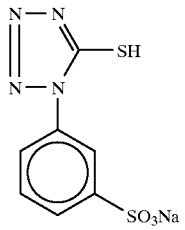

Additive-II

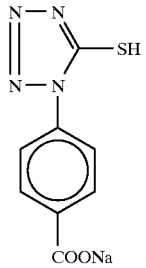

Coating aid-I

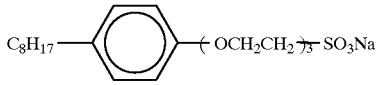

Coating aid-II

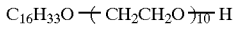

Coating aid-IV

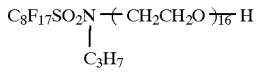

Coating aid-V

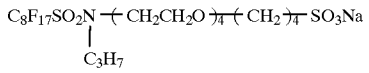

Coating aid-VII

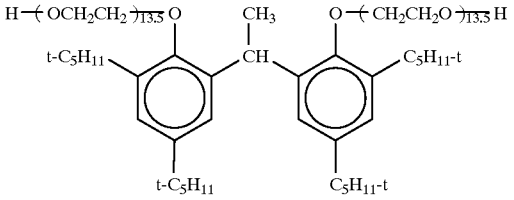

(Preparation of back surface coating fluid)

[Antihalation layer]

(1) Preparation of dye dispersion L:

The following dye-II and oils-I, and -II were dissolved each in an amount of 2.5 g in 50 mL of ethyl acetate, mixed with 90 g of an 8% aqueous solution of gelatin containing 1.5 g of sodium dodecylbenzenesulfonate and 0.18 g of methyl p-hydroxybenzoate at 60° C. and agitated at high velocity by means of a homogenizer. After the completion of the high-velocity agitation, 92% by weight of ethyl acetate was removed by vacuum treatment at 60° C. by means of an evaporator. Thus, dye dispersion L having an average grain size of 0.18 $\mu$m was obtained.

(2) Preparation of coating fluid:

Coating fluid was prepared by using the following components in the following coating amounts.

| | |
|---|---|
| Gelatin | 2.0 g/m$^2$ |
| Phosphoric acid | 5.2 mg/m$^2$ |
| Snotex C (Nissan Chemical Ind., Ltd.) | 0.5 g/m$^2$ |
| Ethyl acrylate/methacrylic acid (97/3) copolymer latex Proxel (produced by ICI) | 0.5 g/m$^2$ |
| Dye dispersion L | 4.2 mg/m$^2$ |
| Dye-III | 8.0 g/m$^2$ |
| Dye-IV | 75 mg/m$^2$ |
| Dye-V | 50 mg/m$^2$ |
| Film hardener (1,2-bis(vinylsulfonyl-acetamido)ethane) | 50 mg/m$^2$ |
| | 40 mg/m$^2$ |

Dye-III

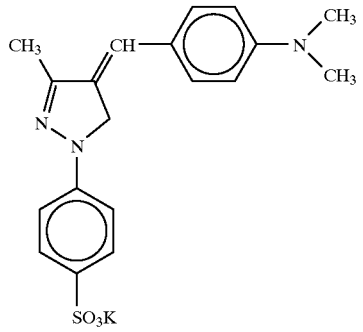

Dye-IV

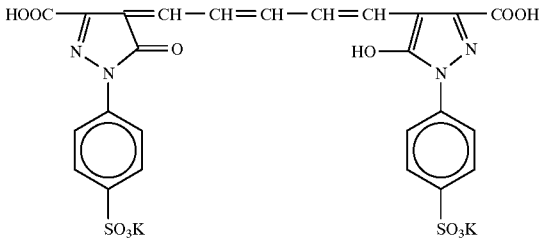

Dye-V

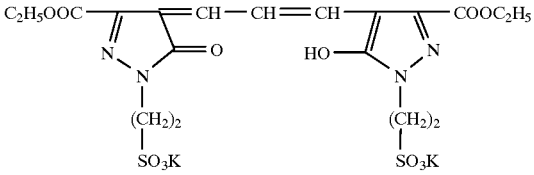

[Surface protective layer]

Coating fluid was prepared by using the following components in the following coating amounts.

| | |
|---|---|
| Gelatin | 1000 mg/m$^2$ |
| Poly(methyl methacrylate) | |
| (av. grain size 3.5 $\mu$m) | 20 |
| (av. grain size 0.75 $\mu$m) | 81 |
| Coating aid-I | 20 |
| Coating aid-II | 40 |
| Coating aid-IV | 6 |
| Coating aid-V | 9 |
| Coating aid-VII | 1.7 |
| Coating aid-IX | 13 |
| Proxel | 1.3 |
| Poly(potassium styrenesulfonate) (av. MW: 600 thousand) | 2 |
| NaOH | 2.5 |

Coating aid-IX 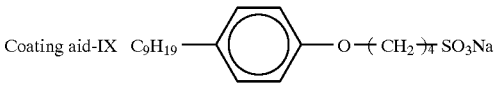

(Preparation of support)

A biaxially oriented polyethylene terephthalate film with a thickness of 183 $\mu$m had its one side subjected to corona discharge, coated with the first subbing coating fluid of the following composition by means of a wire bar coater in a coating amount of 5.1 mL/m$^2$ and dried at 175° C. for 1 min.

Thereafter, the opposite side was also provided with the first subbing layer in the same manner. The employed polyethylene terephthalate was one containing 0.04% by weight of the following dye-II.

| | |
|---|---|
| Butadiene/styrene copolymer latex (solid content: 40%, wt. ratio of butadiene/styrene: 31/69) | 79 mL |
| Sodium salt of 2,4-dichloro-6-hydroxy-s-triazine, 4% aq. soln. | 20.5 |
| Distilled water | 900.5 |

The following emulsifying dispersant was used in the above latex in an amount of 0.4% by weight based on latex solid.

Emulsifying dispersant 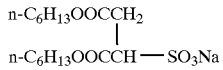

Dye-II 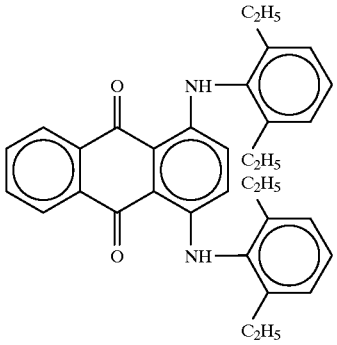

(Preparation of photographic material)

Photographic material for evaluation of the performance of each of emulsions AX to MX was prepared by coating one side of the above provided support with the above back surface antihalation layer and surface protective layer and by coating the opposite side with the emulsion layer and surface protective layer according to the simultaneous extrusion method. The coating amount of silver of the emulsion coated side was 2.7 g/m$^2$.

(Processing)

[Automatic processor]

CEPROS-M manufactured by Fuji Photo Film Co., Ltd. (drive motor and gear part was modified so as to increase conveyance speed).

[Developer concentrate]

| | |
|---|---|
| Sodium hydroxide | 56.6 g |
| Sodium sulfite | 200 |
| Diethylenetriaminepentaacetic acid | 6.7 |
| Potassium carbonate | 16.7 |
| Boric acid | 10 |
| Hydroquinone | 83.3 |
| Diethylene glycol | 40 |
| 4-Hydroxymethyl-4-methyl-1-phenyl-pyrazolidone | 22 |
| 5-Methylbenzotriazole | 2 |
| Treatment aid-I | 0.6 |
| Water | q.s. ad 1.0 L |
| pH | adjusted to 10.60 |

Treatment aid-I 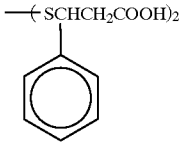

[Fixing solution concentrate]

| | |
|---|---|
| Ammonium thiosulfate | 560 g |
| Sodium sulfite | 60 |
| Disodium ethylenediaminetetraacetate dihydrate | 0.1 |
| Sodium hydroxide | 24 |

-continued

| | |
|---|---|
| Water | q.s. ad 1.0 L |
| pH | adjusted to 5.10 with acetic acid |

Before starting the processing, the tanks of the automatic processor were filled with the following processing solutions.

Developer tank: 333 mL of the above developer concentrate, 667 mL of water and 10 mL of starter containing 2g of potassium bromide and 1.8g of acetic acid were placed and the pH was adjusted to 10.25

Fixing tank: 200 mL of the above fixing solution concentrate and 800 mL of water Processing speed: regulated so that the "dry to dry" is performed within a given period of time Developing temperature: 35° C.

Fixing temperature: 32° C.

Drying temperature: 45° C.

Replenishment rate: developer 22 mL/10×12 inch fixing soln. 30 mL/10×12 inch.

(Evaluation of photographic performance)

Medical multicamera CRT (light emitter P-45) was operated so as to emit light with a density gradient, and each photographic material on its emulsion surface side was exposed thereto for 1 sec. The exposed material was processed by means of the above automatic processor and processing solutions, and the sensitivity was evaluated. The sensitivity was expressed as a relative value of inverse of exposure required for reaching a density of fog density plus 1.0, and assuming that the sensitivity of emulsion AX was 100. The results are listed in Table 5.

adding the silver iodide fine grain emulsion. Secondly, the lower the degree of aggregation of silver iodide fine grains, the higher the photographic sensitivity, and the greater the degree of aggregation, the lower the photographic sensitivity. The lightsensitive silver halide emulsion obtained by forming the extremely thin silver iodide layer existing in the vicinity of emulsion grain surface by the use of the silver iodide fine grain emulsion of the present invention favorably exhibits high photographic sensitivity and is substantially free from the sensitivity drop attributed to storage of the silver iodide fine grain emulsion (storage in a dissolved state and in a refrigerated and set state). The silver iodide content per liter of emulsion is high in the silver iodide fine grain emulsion of the present invention, so that, even in the emulsion production on a practical scale, the volume/weight of the added silver iodide fine grain emulsion can favorably be small to thereby enable rendering addition facilities compact.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

I claim:

1. A silver iodide fine grain emulsion comprising a dispersion medium and fine grains of silver iodide, wherein an average grain size of all the grains contained in the emulsion is 0.02 to 0.07 μm; a silver iodide content per liter of the emulsion in a dissolved state at 40° C. is 0.6 mol or more; and an electric conductivity of the emulsion in a dissolved state at 40° C. is 4,500 to 15,000 μS/cm.

2. The silver iodide fine grain emulsion according to claim 1, wherein the average grain size is 0.03 to 0.05 μm.

TABLE 5

| | AgI fine grain emulsion used to prepare sample | | | | Photographic sensitivity AgI fine grain emulsion used | | | |
|---|---|---|---|---|---|---|---|---|
| Sample (Remarks) | Emulsion No. | AgI content/L of emulsion (mol; 40° C.) | Electirc conductivity (μS/cm; 40° C.) | Gelatin used during grain formation *1 | Immediately after preparation | After storage at dissolved state; 50° C./6 H | After storage at dissolved state; 35° C./30 D | After storage at set state; 10° C./120 D |
| AX (comp.) | | *AgI fine grain emulsion was not used. | | | 100 | *NO AgI fine grain emulsion was used. | | |
| BX (comp.) | AGI-0 | 0.45 | 2150 | Gelatin-1 | 142 | 139 | 139 | 139 |
| CX (comp.) | AGI-1 | 0.83 | 2010 | Gelatin-1 | 130 | 85 | 75 | 90 |
| DX (comp.) | AGI-2 | 0.83 | 3080 | Gelatin-1 | 139 | 102 | 95 | 112 |
| EX (Inv.) | AGI-3 | 0.83 | 4950 | Gelatin-1 | 139 | 139 | 136 | 139 |
| FX (Inv.) | AGI-4 | 0.83 | 10130 | Gelatin-1 | 142 | 139 | 139 | 142 |
| GX (Inv.) | AGI-5 | 0.83 | 14050 | Gelatin-1 | 139 | 139 | 137 | 142 |
| HX (Comp.) | AGI-6 | 0.83 | 18910 | Gelatin-1 | 139 | 115 | 110 | 125 |
| IX (Inv.) | AGI-7 | 0.83 | 10150 | Gelatin-2 | 145 | 145 | 142 | 142 |
| JX (Inv.) | AGI-8 | 0.83 | 10100 | Gelatin-3 | 142 | 139 | 142 | 142 |
| KX (comp.) | AGI-9 | 0.62 | 2100 | Gelatin-1 | 139 | 100 | 88 | 108 |
| LX (Inv.) | AGI-10 | 0.62 | 10030 | Gelatin-1 | 142 | 140 | 140 | 142 |
| MX (comp.) | AGI-11 | 0.62 | 18100 | Gelatin-1 | 140 | 119 | 110 | 125 |

Note

*1) Gelatin-1: conventional alkali-treated ossein gelatin; Gelatin-2: gelatin with low methionine content; Gelatin-3: gelatin with chemically modified —$NH_2$ groups.

As in Example 2, the following is apparent from the results of Table 5 and the results of Table 1 of Example 1. First, the photographic sensitivity is increased and the emulsion performance is enhanced by changing the method of forming an extremely thin silver iodide layer existing in the vicinity of grain surface of the lightsensitive silver halide emulsion of this Example by addition of an aqueous solution of KI, to the method of forming the silver iodide layer by

3. The silver iodide fine grain emulsion according to claim 1, wherein the electric conductivity is 6,000 to 12,000 μS/cm.

4. The silver iodide fine grain emulsion according to claim 1, wherein the silver iodide fine grain emulsion was produced by using, in a step from grain formation to completion of desalting, a gelatin whose methionine residue content is 30 μmol/g or less, or a gelatin having —$NH_2$ groups, 60% or more of which are chemically modified.

5. The silver iodide fine grain emulsion according to claim 4, wherein the average grain size is 0.03 to 0.05 μm.

6. The silver iodide fine grain emulsion according to claim 4, wherein the electric conductivity is 6,000 to 12,000 μS/cm.

7. A lightsensitive silver halide emulsion comprising lightsensitive silver halide grains, wherein the lightsensitive silver halide grains were produced through a growing step in which silver halide grains are grown by adding a silver iodide fine grain emulsion comprising a dispersion medium and fine grains of silver iodide, wherein an average grain size of all the grains contained in the fine grain emulsion is 0.02 to 0.07 μm; a silver iodide content per liter of the fine grain emulsion in a dissolved state at 40° C. is 0.6 mol or more; and an electric conductivity of the fine grain emulsion in a dissolved state at 40° C. is 4,500 to 15,000 μS/cm.

8. The lightsensitive silver halide emulsion according to claim 7, wherein the silver iodide fine grain emulsion was maintained in a dissolved state from immediately after the preparation thereof to the addition for growing the lightsensitive silver halide grains.

9. The lightsensitive silver halide emulsion according to claim 8, wherein the temperature of the silver iodide fine grain emulsion while maintained in the dissolved state is 35 to 50° C.

10. The lightsensitive silver halide emulsion according to claim 8, wherein the lightsensitive silver halide emulsion is occupied by tabular silver iodobromide grains each having 10 or more dislocation lines per grain, having mutually parallel principal planes composed of (111) faces, and having an aspect ratio of 3 or more, in an amount of 50% or more of the total projected area of all the grains in the silver halide emulsion.

11. The lightsensitive silver halide emulsion according to claim 7, wherein the lightsensitive silver halide emulsion is occupied by tabular silver iodobromide grains each having 10 or more dislocation lines per grain, having mutually parallel principal planes composed of (111) faces, and having an aspect ratio of 3 or more, in an amount of 50% or more of the total projected area of all the grains in the silver halide emulsion.

12. The lightsensitive silver halide emulsion according to claim 11, wherein the temperature of the silver iodide fine grain emulsion while maintained in the dissolved state is 35 to 50° C.

13. The lightsensitive silver halide emulsion according to claim 11, wherein the aspect ratio is 5 or more and the amount is 70% or more.

14. The lightsensitive silver halide emulsion according to claim 7, wherein the silver iodide fine grain emulsion was produced by using, in a step from grain formation to completion of desalting, a gelatin whose methionine residue content is 30 μmol/g or less, or a gelatin having —$NH_2$ groups, 60% or more of which are chemically modified.

15. The lightsensitive silver halide emulsion according to claim 14, wherein the silver iodide fine grain emulsion was maintained in a dissolved state from immediately after the preparation thereof to the addition for growing the lightsensitive silver halide grains.

16. A silver halide photographic lightsensitive material, comprising a support and, superimposed thereon, at least one lightsensitive silver halide emulsion layer, wherein the lightsensitive silver halide emulsion layer contains a lightsensitive silver halide emulsion comprising lightsensitive silver halide grains, wherein the lightsensitive silver halide grains were produced through a growing step in which silver halide grains are grown by adding a silver iodide fine grain emulsion comprising a dispersion medium and fine grains of silver iodide, wherein an average grain size of all the grains contained in the silver iodide fine grain emulsion is 0.02 to 0.07 μm; a silver iodide content per liter of the fine grain emulsion in a dissolved state at 40° C. is 0.6 mol or more; and an electric conductivity of the fine grain emulsion in a dissolved state at 40° C. is 4,500 to 15,000 μS/cm.

17. The silver halide photographic lightsensitive material according to claim 16, wherein the silver iodide fine grain emulsion was maintained in a dissolved state from immediately after the preparation thereof to the addition for growing the lightsensitive silver halide grains.

18. The silver halide photographic lightsensitive material according to claim 16, wherein the lightsensitive silver halide emulsion contained in the layer is occupied by tabular silver iodobromide grains each having 10 or more dislocation lines per grain, having mutually parallel principal planes composed of (111) faces, and having an aspect ratio of 3 or more, in an amount of 50% or more of the total projected area of all the grains in the lightsensitive silver halide emulsion.

19. The silver halide photographic lightsensitive material according to claim 16, wherein the silver iodide fine grain emulsion was produced by using, in a step from grain formation to completion of desalting, a gelatin whose methionine residue content is 30 μmol/g or less, or a gelatin having —$NH_2$ groups, 60% or more of which are chemically modified.

* * * * *